US008009094B2

(12) United States Patent
Freed

(10) Patent No.: US 8,009,094 B2
(45) Date of Patent: Aug. 30, 2011

(54) METHOD FOR PRODUCING WAVEFRONTS AT A DESIRED ANGLE

(75) Inventor: Peter David Freed, Bellevue Hill (AU)

(73) Assignee: Cirrus Real Time Processing Systems Pty Ltd (AU)

( * ) Notice: Subject to any disclaimer, the term of this patent is extended or adjusted under 35 U.S.C. 154(b) by 306 days.

(21) Appl. No.: 12/045,719

(22) Filed: Mar. 11, 2008

(65) Prior Publication Data

US 2008/0224929 A1 Sep. 18, 2008

Related U.S. Application Data

(60) Provisional application No. 60/894,231, filed on Mar. 12, 2007.

(51) Int. Cl.
*H01Q 3/00* (2006.01)

(52) U.S. Cl. ..... 342/360; 342/377

(58) Field of Classification Search ..... 342/360, 342/377, 451, 452; 455/456.2, 456.3
See application file for complete search history.

(56) References Cited

U.S. PATENT DOCUMENTS

| | | | | |
|---|---|---|---|---|
| 4,885,725 | A * | 12/1989 | McCarthy et al. | 367/129 |
| 7,274,442 | B2 * | 9/2007 | Dolne et al. | 356/121 |
| 2008/0112265 | A1 * | 5/2008 | Urbano et al. | 367/87 |

* cited by examiner

*Primary Examiner* — Dao Phan
(74) *Attorney, Agent, or Firm* — Galbreath Law Offices, P.C.; John A. Galbreath

(57) ABSTRACT

An apparatus and method is described for generating an electromagnetic, or acoustic field by use of a number of field sources in order to produce a field anomaly at a known target location. The field anomaly is characterized by having a wavefront at the target location that has a predetermined desired orientation so that at the target location the field appears to emanate from a different direction to that perceived at field locations away from the target.

18 Claims, 9 Drawing Sheets

METHOD FOR PRODUCING WAVEFRONTS AT A DESIRED ANGLE

CROSS-REFERENCES TO RELATED APPLICATIONS

This application claims priority from, and the benefit of, applicant's provisional U.S. Patent Application No. 60/894,231, filed Mar. 12, 2007 and titled "METHOD FOR PRODUCING WAVEFRONTS AT A DESIRED ANGLE".

1.0 FIELD OF THE INVENTION

The present invention relates to a method of operating signal sources in order to produce wavefronts having a desired orientation in a particular predetermined location. Embodiments of the invention may be used in projectile defense applications such as torpedo or missile defense systems.

2.0 BACKGROUND TO THE INVENTION

Remote sensing systems are frequently employed that 'sense' the environment at a distance by means of electronic sensors. Such electronic sensors will typically attempt to intercept fields that are radiated or reflected by objects of interest.

The intent of deploying such sensors is to aid in answering two fundamental questions:

Where is the object of interest ?

What is the object of interest ?

To aid in answering the first question, Huygen's principle is often utilised. This principle essentially dictates that signals propagating from a source through space have (at some distance from the source) wavefronts that are perpendicular to the direction of propagation. To assess the direction of arrival of a signal, a sensor must deduce the orientation of the wavefront carrying the signal, and the DOA will be perpendicular to that. To accomplish this, sensors will use an aperture of non-zero dimension.

To aid in answering the second question, a sensor may attempt to analyse the signal that is received from the object of interest.

In conjunction with the development of sensor systems, much effort has been devoted to the development of electronic counter-measures that platforms might deploy that attempt to deceive opposing force's sensors.

Jamming is one approach to countermeasures, that aims to emit a signal that is so strong, all other signals received by the opposing forces's sensors are 'blotted out'. However, if the sensors incorporate appropriate filters, the effect of the jamming signal can be nullified, and the ability of the sensor to monitor other targets may be unhindered.

Furthermore, the sensor will be able to determine the source direction of the jammer. Another approach to countermeasures is to transmit deceptive signals, with the intent of deceiving the opposing sensor into deducing that the platform is something other than that which it really is. An example may be a submarine transmitting underwater acoustic signals reminiscent of whale mating calls.

The drawback of this approach is that transmission of such a signal will enable opposing force sensors to localise the source of the emanation. Hence this approach trades off helping opposing forces find the platform, against hindering opposing forces understand the identity of the platform. This trade might actually give away more than it gains for own forces.

Both jamming and the transmission of deceptive signals suffer from the same common problem. Transmission of a signal through space creates wavefronts that essentially create an arrow pointing back to the source of the signal, and help opposing forces answer the first fundamental question.

It is an object of the present invention to provide an electronic countermeasure capable of transmitting signals that deceive the opposing force as to the where the source is.

3.0 SUMMARY OF THE INVENTION

The present invention relates to techniques for creating fields that may be emitted from field source so that the sources appear to be located at other than its true position. In most situations at least three sources are necessary.

"Ventriloquial Effect Field" techniques will be subsequently described that work in conjunction with a multiple element source containing a plurality of independent and controllable sources.

It is preferable that each source be able to emit a signal that is controllable independently of the other sources.

The ventriloquial effect generated by a VEF is not universal, but can be arranged to produce a field anomaly at a particular target location.

Through the use of VEF, the field anomaly is generated at the target location. This anomaly affects the angle of the field wavefronts at that location so that instead of lying perpendicular to the line of propagation (i.e. the line back to the source), the wavefront is skewed to a desired angle of orientation. This is referred to as the Ventriloquial Field Anomaly (VFA).

According to a first aspect of the present invention there is provided a computer software product for execution by one or more electronic processors including instructions to process

- source location data, specifying the location of a number of field sources, and
- target location data, specifying a target location; and
- wavefront orientation data specifying a desired orientation
- to produce signal parameters of the field sources for a field having an anomalous region at the target location including a wavefront of the desired orientation.

Preferably said instructions include:

- instructions to determine roots of a condition function for the desired orientation to be produced at the target location; and
- instructions to determine the signal parameters as a function of said roots.

The software product may further include:

- instructions to generate signals corresponding to the signal parameters for delivery to each of the number of sources.

Preferably the signal parameters include the phases of the signals to be applied to the sources in order to generate a field having a wavefront of the desired orientation at the anomaly that will be presented to the target location.

It is preferred that the software product includes a preliminary processing step of rotating coordinates of the sources and target through an angle corresponding to the desired orientation.

In a preferred embodiment the function defining the condition includes

- a summation of
  - the product of
    - ratios of path distances by the cosine of signal phase angle differences at the target position due to the sources.

Preferably the computer software product includes instructions to compute a field power function and the instructions to determine roots of the condition function take into account the field power function in order that field power at the target location be increased.

In one embodiment of the invention the software product includes instructions to group the number of sources into a plurality of groups and instructions to determine roots of the condition function corresponding to each group.

In this last mentioned embodiment the software product will preferably also include instructions to determine a group phase angle contribution, at the target location, for each group.

Preferably the software product also includes instructions to deduce a phase angle for each of the sources of the group on the basis of the corresponding group phase contribution and the roots of the condition function.

The computer software product may further include:

instructions to calculate a digital signal at each source on the basis of the determined signal parameters and a predetermined deception signal.

Preferably the instructions to determine the roots of the condition function implement a Newton-Raphson Method.

According to a further aspect of the present invention there is provided a counter-electronic surveillance system including a computational device programmed with a computer software product according to any one of the preceding claims.

According to another aspect of the present invention there is provided a method of operating a computational device to produce signal parameters in respect of a plurality of field sources for a field having an anomaly at a target location, said anomaly being characterized by a wavefront of a desired orientation, the method including:

determining roots of a condition function for the desired orientation to be produced at the target location; and determining the signal parameters as a function of said roots.

Preferably the method includes:

determining the roots of the condition function with reference to a field power function, for increasing field power at the target location.

In a preferred embodiment the method also includes:

grouping field sources into a number of groups;

determining roots of the condition function corresponding to each group;

determining a group phase contribution at the target location corresponding to each group; and deducing a phase for each of the sources of each group as a function of the corresponding group phase contribution and the corresponding roots of the condition function.

Preferably the method includes calculating a digital signal corresponding to each source on the basis of the determined signal parameters and a predetermined deception signal.

According to another aspect of the present invention there is provided a counter electronic surveillance system arranged to implement a method according to the method.

The present invention provides a technique for creating fields that may be emitted from a source so that the source appears to be located at other than its true position.

The VEF techniques work in conjunction with a multiple element source containing a plurality of independent and controllable sources.

It is preferable that each source be able to emit a signal that is controllable independently of the other sources.

The ventriloquial effect generated by VEF is not universal, but can be arranged to produce a field anomaly at a particular location.

Through the use of VEF, the field anomaly is generated at the target location. This anomaly affects the angle of the field wavefronts at that location so that instead of lying perpendicular to the line of propagation (i.e. the line back to the source), the wavefront is skewed to a selected angle of orientation. This is referred to as the Ventriloquial Field Anomaly (VFA).

The steps involved in implementing methods according to embodiments of the present invention are set out in the following sections.

4.0 DESCRIPTION OF THE FIGURES

5.0 DETAILED DESCRIPTION

5.1 Theoretical Background

Figure 1:
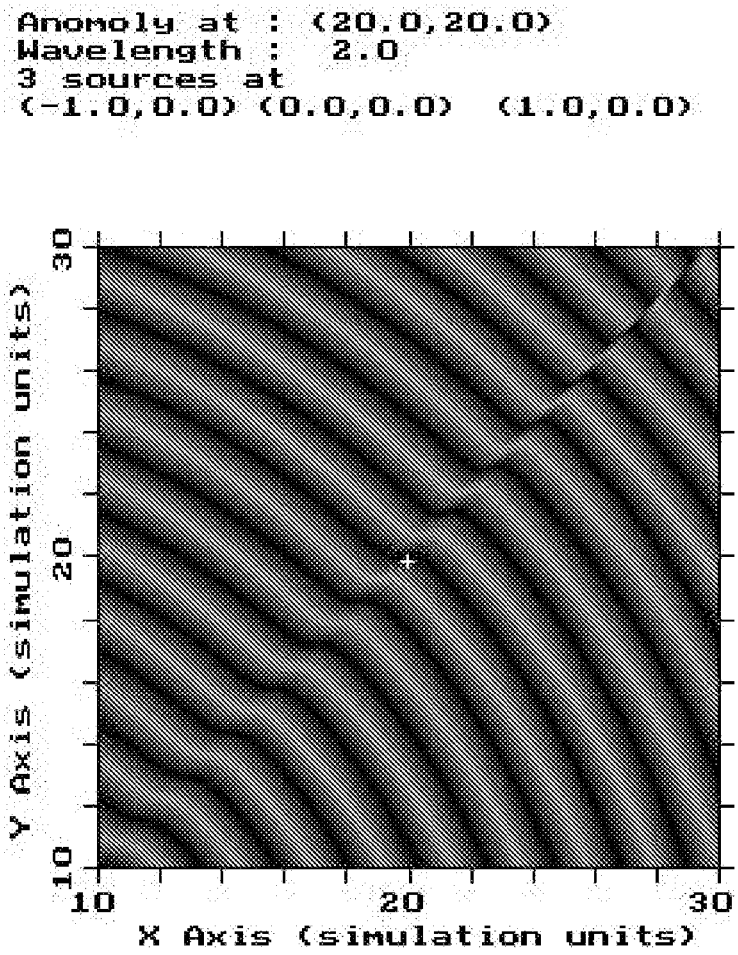
FIG. 1 is a field phase plot of a field produced according to an embodiment of the present invention.

5.1.1 Field Phase for a Multi-Transducer Source

Consider an acoustic or electromagnetic field established through the activation of N sources. Let each source transmit signals with a common frequency f with unit amplitude.

Wavefronts from each of these sources will generate the surrounding field. The contribution to the field at position (xy) from the $i^{th}$ source can be modeled as $$E_i(x,y)=RL\{e^{j2\pi fi+j\theta_i}\}$$

where $\theta_i$ is the phase at the field point (x,y) and is evaluated as the sum of the start phase $\phi_i$ of the signal at the transducer, and a phase delay term $\Phi_i$ induced by the propagation.

$$\theta_i = \phi_i + \varphi_i$$

$$\varphi_i = \frac{-2\pi f}{c} PD_i(x, y)$$

Where c is the speed of propagation of the wave in the propagating medium.

Note that the path difference to the field from this $i^{th}$ transducer is simply $$PD_i = \sqrt{(x-x_i)^2+(y-y_i)^2}$$

The total field $E_T(x,y)$ at position (x,y) can be found by summation of the contributions from each transducer's wavefront. After some manipulation of the equations the result is:

$$E_T(x,y) = \cos(2\pi ft + \Phi(x,y)) \cdot A(x,y) \qquad \text{Eqn. A}$$

where the total field and phase amplitude functions are defined as:

$$\Phi(x, y) = \arctan\left(\frac{U(x, y)}{V(x, y)}\right)$$

$$A(x, y) = \sqrt{U^2(x, y) + V^2(x, y)}\text{; and}$$

$$V(x, y) = \sum_{i=1}^{N} \cos[\theta_i]$$

$$U(x, y) = \sum_{i=1}^{N} \sin[\theta_i]$$

5.1.2 The Ventriloquial Field Condition

By definition, a wavefront is the locus of positions which share the same phase, i.e. an equiphase front.

If it is desired to create a skewed wavefront at some position (xy), we need to ensure that $$\Phi(x+dx, y+dy) = \Phi(xy)$$

This condition creates a wavefront between positions (x,y) and (x+dx, y+dy).

By choosing the coordinate of the second component carefully, it is possible to create such a wavefront at an angle other than would naturally arise from concentric wavefront alignment.

For example, consider an offset (dx, dy)=(dx, $\alpha \cdot dx$) so that the equiphase front is established at an angle $\chi$ $$\chi = \arctan(\alpha \cdot dx/dx) = \arctan(\alpha) \text{ to the x axis.}$$

The first few terms of the Taylor series expansion of the total field phase function is as follows $$\Phi(x + dx, y + dy) \approx \Phi(x, y) + dx \cdot \frac{\partial \Phi}{\partial x} + dy \cdot \frac{\partial \Phi}{\partial y}$$

By making the right side of the equation equal to the field phase at (xy), we arrive at the approximate condition for the equiphase front as follows:

$$\Phi(x, y) + dx \cdot \frac{\partial \Phi}{\partial x} + dy \cdot \frac{\partial \Phi}{\partial y} = \Phi(x, y)$$

$$\Phi(x, y) + dx \cdot \frac{\partial \Phi}{\partial x} + dy \cdot \frac{\partial \Phi}{\partial y} = \Phi(x, y)$$

-continued $$\therefore dx \cdot \frac{\partial \Phi}{\partial x} + dy \cdot \frac{\partial \Phi}{\partial y} = 0$$

substituting $\alpha \cdot dx$ for dy into the above expression we arrive at:

$$\therefore 0 = \frac{\partial \Phi}{\partial x} + \alpha \cdot \frac{\partial \Phi}{\partial y} \qquad \text{Eqn. B}$$

This last equation is the condition that must be met for a ventriloquial field to exist at a target location (xy).

5.1.3 Operation of N Sources to Generate a Ventriloquial Field

From the equation for the total field due to N sources at (x,y) (Equation A.) and the condition for the equiphase front (Equation B.) the present inventor has arrived at the following condition $$0 = \sum_{i=1}^{N} \sum_{k=1}^{N} \left(\frac{(x - x_k) + \alpha \cdot (y - y_k)}{PD_k}\right) \cdot \cos(\theta_i - \theta_k). \qquad \text{Eqn. C}$$

Equation C may be considered as imposing a single condition on the choice of the N free variables $\theta_1, \theta_2, \ldots, \theta_N$ to establish a wavefront at a field location (xy) at an angle of $\chi = \arctan(\alpha)$ to the x axis. If this angle is chosen to be different from the natural angle of concentric wavefronts then a local anomaly will be created in the vicinity of the point (x,y). The wavefronts in this vicinity will be skewed.

As there are N free variables but only one condition, it is reasonable to believe that a choice of these variables may be found which satisfies this condition. Once these variables are found, by application of standard numerical techniques, the corresponding source phases may be computed as $$\varphi_i = \theta_i - \phi_i$$

$$= \theta_i + \frac{2\pi f}{c} PD_i(x, y)$$

An immediate reduction in complexity of the analysis may be achieved by making use of simple geometric transformation.

It will be recalled that we have defined the field anomaly location, and desired wavefront angle all in terms of a Cartesian coordinate system.

It is therefore possible to express these same variables in terms of a different coordinate system, while maintaining the integrity of the solution.

This is done by rotating all source and field coordinates around the origin through $\chi$ radians in an anticlockwise direction.

This is exactly equivalent to a rotation of all sensor and field coordinates around the origin of $-\chi$ radians, and a reduction of the desired wavefront angle from $\chi$ radians to zero.

the coordinate transform is then simply:

$$\begin{bmatrix} x_{new} \\ y_{new} \end{bmatrix} = \begin{bmatrix} \cos\chi & \sin\chi \\ -\sin\chi & \cos\chi \end{bmatrix} \begin{bmatrix} x_{old} \\ y_{old} \end{bmatrix}$$

By applying the above the desired derivative of phase with respect to the new y axis becomes exactly. Consequently, Equation C. simplifies to the following under application of the transformation:

$$0 = \sum_{i=1}^{N} \sum_{j=1}^{N} \left( \frac{(x - x_j)}{PD_j(x, y)} \right) \cdot \cos(\theta_i - \theta_j) \qquad \text{Eqn. D}$$

5.1.4 Incorporating Amplitude Effects

The conditions for creating a VAF anomaly previously derived have been based on the assumption that the wavefronts emanating from the N transducers do not suffer any loss of amplitude as they propagate towards the field anomaly point. While this approach allows for a simple mathematical analysis, it does not provide an accurate model of the world.

A more realistic approach may be based on a model for a wavefront in which its amplitude reduces in accordance with spherical spreading, $$E_i(x, y) = \frac{a_i}{PD_i^2(x, y)} \cdot RL\{\exp[j2\pi ft + j\theta_i]\}$$

where $a_i$ represents the source amplitude level for the i'th sensor. As previously, $\theta_i$ represents the signal phase at the field position (x,y), and is composed of $$\theta_i \phi_i + \phi_i$$

where $\phi_i$ is the signal phase at the transducer, and $$\phi_i = \frac{-2\pi f}{c} PD_i(x, y)$$

represents as usual the phase delay experienced by the wavefront in travelling from the source to the field location (x,y). The total field at position (x,y) can be found by superposing contributions from each transducer's wavefront $$\begin{aligned} E(x, y) &= \sum_{i=1}^{N} E_i(x, y) \\ &= \sum_{i=1}^{N} \frac{a_i}{PD_i^2(x, y)} \cdot RL\{\exp[j2\pi ft] \cdot \exp[j\theta_i]\} \\ &= RL\left\{ \sum_{i=1}^{N} \frac{a_i}{PD_i^2(x, y)} \cdot \exp[j2\pi ft] \cdot \exp[j\theta_i] \right\} \\ &= RL\left\{ \exp[j2\pi ft] \cdot \sum_{i=1}^{N} \frac{a_i}{PD_i^2(x, y)} \cdot \exp[j\theta_i] \right\} \\ &= RL\{(\cos[2\pi ft] + j\sin[2\pi ft]) \cdot (V(x, y) + jU(x, y))\} \end{aligned}$$

where V and U are the real and imaginary components of the summation.

$$\begin{aligned} V(x, y) &= RL\left\{ \sum_{i=1}^{N} \frac{a_i}{PD_i^2} \cdot \exp[j\theta_i] \right\} \\ &= \sum_{i=1}^{N} \frac{a_i}{PD_i^2} \cdot \cos[\theta_i] \end{aligned}$$

$$\begin{aligned} U(x, y) &= \mathrm{IM}\left\{ \sum_{i=1}^{N} \frac{a_i}{PD_i^2} \cdot \exp[j\theta_i] \right\} \\ &= \sum_{i=1}^{N} \frac{a_i}{PD_i^2} \cdot \sin[\theta_i] \end{aligned}$$

It follows that $$\begin{aligned} E(x, y) &= \cos[2\pi ft] \cdot V(x, y) - \sin[2\pi ft] \cdot U(x, y) \\ &= \cos(2\pi ft + \Phi(x, y)) \cdot A(x, y) \end{aligned}$$

where the total field phase and amplitude functions are defined as $$\Phi(x, y) = \arctan\left( \frac{U(x, y)}{V(x, y)} \right)$$

$$A(x, y) = \sqrt{U^2(x, y) + V^2(x, y)}$$

We desire to establish an equiphase front parallel to the x axis, so that $$\Phi(x+dx,y)=\Phi(x,y)$$

$$\therefore \partial\Phi/\partial x=0$$

The partial derivative can be expressed as $$\frac{\partial \Phi}{\partial x} = \frac{1}{(V^2 + U^2)} \left( V \frac{\partial U}{\partial x} - U \frac{\partial V}{\partial x} \right)$$

so, the equiphase condition becomes:

$$0=V\partial U/\partial x-U\partial V/\partial x$$

From the definitions of U and V, we obtain $$\frac{\partial U}{\partial x} = \sum_{i=1}^{N} \frac{a_i}{PD_i^2} \cdot \left[ \cos\theta_i \frac{\partial \theta_i}{\partial x} - \frac{2\sin\theta_i \cdot (x - x_i)}{PD_i^2} \right]$$

$$\frac{\partial V}{\partial x} = -\sum_{i=1}^{N} \frac{a_i}{PD_i^2} \cdot \left[ \sin\theta_i \frac{\partial \theta_i}{\partial x} + \frac{2\cos\theta_i \cdot (x - x_i)}{PD_i^2} \right]$$

which may be substituted into the equiphase condition.

$$0 = \sum_{i=1}^{N} \frac{a_i}{PD_i^2} \cdot \cos\theta_i \cdot \sum_{k=1}^{N} \frac{a_k}{PD_k^2} \cdot \left[ \cos\theta_{ki} \frac{\partial \theta_k}{\partial x} - \frac{2\sin\theta_k (x - x_k)}{PD_k^2} \right] - \sum_{i=1}^{N} \frac{a_i}{PD_i^2} \cdot \sin\theta_i \cdot (-) \sum_{k=1}^{N} \frac{a_k}{PD_k^2} \cdot \left[ \sin\theta_k \frac{\partial \theta_k}{\partial x} + \frac{2\cos\theta_k \cdot (x - x_k)}{PD_k^2} \right]$$

-continued $$\therefore 0 = \sum_{i=1}^{N}\sum_{k=1}^{N} \frac{a_i}{PD_i^2}\cdot\frac{a_k}{PD_k^2}\cos\theta_i\cdot\cos\theta_{ki}\frac{\partial\theta_k}{\partial x} + \sum_{i=1}^{N}\sum_{k=1}^{N} \frac{a_i}{PD_i^2}\cdot\frac{a_k}{PD_k^2}\cos\theta_i\cdot\left[-\frac{2\sin\theta_k\cdot(x-x_k)}{PD_k^2}\right] + \sum_{i=1}^{N}\sum_{k=1}^{N} \frac{a_i}{PD_i^2}\cdot\frac{a_k}{PD_k^2}\sin\theta_i\cdot\sin\theta_k\frac{\partial\theta_{ki}}{\partial x} + \sum_{i=1}^{N}\sum_{k=1}^{N} \frac{a_i}{PD_i^2}\cdot\frac{a_k}{PD_k^2}\sin\theta_i\cdot\sin\theta_k\cdot\left[\frac{2\sin\theta_{ki}\cdot(x-x_k)}{PD_k^2}\right]$$

This expression can be rearranged to collect like terms $$\therefore 0 = \sum_{i=1}^{N}\sum_{k=1}^{N} \frac{a_i}{PD_i^2}\cdot\frac{a_k}{PD_k^2}\frac{\partial\theta_k}{\partial x}[\cos\theta_i\cdot\cos\theta_k + \sin\theta_i\sin\theta_k] + \sum_{i=1}^{N}\sum_{k=1}^{N} \frac{a_i}{PD_i^2}\cdot\frac{a_k}{PD_k^2}\cdot\frac{-2\cdot(x-x_k)}{PD_k^2}\cdot [\cos\theta_i\sin\theta_k - \cos\theta_k\sin\theta_i].$$

$$= \sum_{i=1}^{N}\sum_{k=1}^{N} \frac{a_i}{PD_i^2}\cdot\frac{a_k}{PD_k^2}\frac{\partial\theta_k}{\partial x}\cos(\theta_i-\theta_k) - \sum_{i=1}^{N}\sum_{k=1}^{N} \frac{a_i}{PD_i^2}\cdot\frac{a_k}{PD_k^2}\cdot\frac{2\cdot(x-x_k)}{PD_k^2}\cdot\sin(\theta_k-\theta_i)$$

We are free to choose values for the source amplitudes. A sensible use of this freedom is to choose the values so that the amplitudes of all of the wavefronts have equal amplitude at the field point where we choose to site the anomaly.

Hence $$a_i = P\cdot PD_i^2$$

where P is an arbitrary base amplitude level. Substituting these source levels into the equiphase condition, we obtain the following $$\therefore 0 = \sum_{i=1}^{N}\sum_{k=1}^{N} P^2\frac{\partial\theta_k}{\partial x}\cos(\theta_i-\theta_k) - \sum_{i=1}^{N}\sum_{k=1}^{N} P^2\cdot\frac{2\cdot(x-x_k)}{PD_k^2}\cdot\sin(\theta_k-\theta_i)$$

From the definition of the path phase delay θ, we may obtain the partial derivative $$\frac{\partial\theta_k}{\partial x} = \frac{-2\pi f}{c}\frac{(x-x_k)}{PD_k}$$

which may be substituted into the equiphase condition $$\therefore 0 = -\sum_{i=1}^{N}\sum_{k=1}^{N} \frac{2\pi f}{c}\frac{(x-x_k)}{PD_k}\cdot\cos(\theta_i-\theta_k) - \sum_{i=1}^{N}\sum_{k=1}^{N} \frac{2\cdot(x-x_k)}{PD_k^2}\cdot\sin(\theta_k-\theta_i)$$

$$= \sum_{i=1}^{N}\sum_{k=1}^{N} \frac{(x-x_k)}{PD_k}\cdot\left[\frac{2\pi f}{c}\cos(\theta_i-\theta_k) + \frac{2}{PD_k}\sin(\theta_k-\theta_i)\right]$$

$$\therefore 0 = \sum_{i=1}^{N}\sum_{k=1}^{N} \frac{(x-x_k)}{PD_k}\cdot\left[\cos(\theta_i-\theta_k) - \frac{2\lambda}{PD_k}\sin(\theta_i-\theta_k)\right]$$

Comparing this equiphase condition to the equivalent condition derived for the constant amplitude case, we note that the only difference is the addition of the final term. This term is weighted by the ratio of the signal wavelength to the path difference to the anomaly point. Clearly, this term will have a negligible effect for any VAF in which the chosen anomaly location is many wavelengths away from the transducer.

The negligible effect of this amplitude dependent term is best illustrated with an example. Consider the following VAF scenario

| | |
|---|---|
| Anomaly Field Location | (20, 20) |
| Source Locations | (−1, 0), (0, 0), (1, 0) |
| Wavelength | 2 |

A field anomaly was generated for this example by solving the simple equiphase condition; i.e. The effect of amplitude was ignored in determining the solution. The resulting source phase and amplitudes were then used to determine the field function around the anomaly point. This computation of field phase and amplitude has been performed using spherical spreading, so it does provide an accurate picture of the field amplitude and phase for the given source conditions. The results of this field generation are displayed in FIGS. 1 and 2. Note that a field anomaly is located at the desired location.

In the case the field anomaly was located approximately 14 wavelengths away from the center of the transmit array, so the weighting on the amplitude dependent term was only one seventh of the dominant terms. Even at this relatively small distance, the effects of these final terms has not been substantial.

5.1.5 Solving the VAF Condition

Equation D., $$\text{i.e. } 0 = \sum_{i=1}^{N}\sum_{j=1}^{N}\left(\frac{(x-x_j)}{PD_j(x,y)}\right)\cdot\cos(\theta_i-\theta_j)$$

which is the condition function under the rotated coordinate system, will be satisfied by finding the root of the function $$C1(\theta_1,\theta_2,\ldots,\theta_N) = \sum_{i=1}^{N}\sum_{j=1}^{N} g(i,j)\cdot\cos(\theta_i-\theta_j);\text{ where}$$

$$g(i,j) = \frac{(x-x_j)}{PD_j(x,y)}$$

A cursory investigation of this function reveals that it is in fact only dependent on the difference between the angles. It follows that:

$$C1(\theta_1+\Delta, \theta_2+\Delta, \ldots, \theta_N+\Delta) = \sum_{i=1}^{N}\sum_{j=1}^{N} g(i, j)\cdot \cos(\theta_i+\Delta-\theta_j-\Delta);$$
$$= \sum_{i=1}^{N}\sum_{j=1}^{N} g(i, j)\cdot\cos(\theta_i-\theta_j)$$
$$= C1(\theta_1, \theta_2, \ldots, \theta_N)$$

Hence, it is possible to set $\theta_1=0$ without loss of generality, and obtain a solution by careful choice of $\theta_2, \theta_3, \ldots, \theta_N$ only.

5.1.5.1 Solution by Newton-Rhaphson Algorithm

The first order Taylor series expansion of C1 near ($\theta_2$, $\theta_3, \ldots \theta_N$) may be stated as $$C1(0,_2\ \theta_2, \theta_3, \ldots, \theta_p+d\theta_p+, \ldots \theta_N) \approx C1(0, \theta_2, \theta_3, \ldots, \theta_p, \ldots, \theta_N) + d\theta p\frac{\partial C1}{\partial\theta p}$$

where p=2, 3, . . . , N. By setting the right hand side of this equation exactly equal to zero it is possible to obtain an expression for an update to the angle $\theta_p$ which will help move the condition function C1 "closer" to a zero.

$$0 = C1(0, \theta_2, \theta_3, \ldots, \theta_p, \ldots, \theta_N) + d\theta p\frac{\partial C1}{\partial\theta p}$$
$$\therefore d\theta p = \frac{-C1(0,_2\ \theta_2, \theta_3, \ldots, \theta_p, \ldots, \theta_N)}{\frac{\partial C1}{\partial\theta p}}$$

To use the above expression as the basis for a numerical method it is necessary to obtain expressions for the partial derivatives $$\frac{\partial C1}{\partial\theta p};\ p = 2, 3, \ldots, N$$

5.1.5.2 Evaluation of the Partial Derivatives of C1

Recall that C1 is defined as $$C1(\theta_1, \theta_2, \ldots, \theta_N) = \sum_{i=1}^{N}\sum_{j=1}^{N} g(i, j)\cdot\cos(\theta_i-\theta_j);\ \text{where}$$
$$g(i, j) = \frac{(x-x_j)}{PD_j(x, y)}$$

If we wish to find the derivative of C1 with respect to $\theta_p$ p=1, 2, . . . , N, we must note that angle appears in the expression for C1 in the guise of both $\theta_i$ and $\theta_j$. To account for this, we may express C1 in a more expansive format which isolates all cases where the angle $\theta_p$ is present.

$$C1(\theta 2, \theta 3, \ldots, \theta N) = \sum_{i=1}^{N}\sum_{j=1}^{N} g(i, k)\cdot\cos(\theta_i-\theta_j)$$
$$= \sum_{i\neq p}\sum_{j\neq p} g(i, k)\cdot\cos(\theta_i-\theta_j) + \sum_{i\neq p, j=p} g(i, k)\cdot\cos(\theta_i-\theta_j) + \sum_{i=p, j\neq p} g(i, k)\cdot\cos(\theta_i-\theta_j) +_{i=p, k=p} g(i, k)\cdot\cos(\theta_i-\theta_j)$$

From this we may deduce that:

$$\frac{\partial C1}{\partial\theta_p} = \sum_{i\neq p, j=p} g(i, p)\cdot\sin(\theta_i-\theta_p) - \sum_{j\neq p} g(p, k)\cdot\sin(\theta_i-\theta_p)$$
$$\frac{\partial C1}{\partial\theta_p} = \sum_{i\neq p,} (g(i, p)+g(p, i))\cdot\sin(\theta_i-\theta_p)$$

These derivatives may be used in the Newton-Raphson method as follows:

1. Initialise solution vector $\theta_2, \theta_3, \ldots \theta_N$
2. Set p=2
3. Evaluate function C1 ($\theta_2, \theta_3, \ldots \theta_N$)
4. Evaluate partial derivative $$\frac{\partial C1}{\partial\theta_p}$$

5. Compute update $d\theta_p$
6. Update angle $\theta_p=\theta_p+d\theta_p$
7. Set p=p+1
8. If (p>N) goto step 2.
9. Goto step 3.

The inventor has tested this method experimentally and found it to exhibit excellent convergence properties.

5.1.6 Multi-Frequency VAF System

The analysis previously presented has assumed the transmission of a single frequency signal. Such an assumption may be broadly applicable, as active transducers are often designed to generate maximum power at a particular transmit frequency.

However, there are cases where this limitation does not apply, and it is useful to generate signals with a broader bandwidth. Consider a transmitted signal s(t) which consists of energy from across a range of frequencies $$s(t)=\int A(f)\cdot\cos(2\pi ft+\beta(f))df$$

where A(f) and β(f) are real valued functions defining the amplitude and phase of the signal s(t) as a function of frequency. This signal can be more conveniently represented as $$s(t)=Re\{\int A(f)\cdot\exp(j2\pi ft+j\beta(f))df\}$$

It is desired that this signal is transmitted from an array of active transducers located at positions ($x_i$, $y_i$). Let the signal transmitted from the i'th element be $$s_i(t)=Re\{\int A(f)\cdot\exp(j2\pi ft+j\beta(f)+j\phi_i(f))df\}$$

where $\phi_i$ (f) is a function describing additional phase offsets applied at independently at each sensor to the components of the transmitted signal at frequency f.

The signal observed at a field location (x,y) due to this element will be $$E_i(t, x, y) = s_i\left(t - \frac{PD_i(x, y)}{c}\right)$$

$$\therefore E_i(t, x, y) = \mathrm{Re}\left\{\int A(f)\cdot\exp\left(j2\pi f\left(t - \frac{PD_i}{c}\right) + j\beta(f) + j\varphi_i(f)\right)df\right\}$$

$$= \mathrm{Re}\left\{\int A(f)\cdot\exp(j2\pi ft + j\beta(f))\cdot \exp\left(-j2\pi f\frac{PD_i}{c}\right)\cdot\exp(j\varphi_i(f))df\right\}$$

Define the following terms $$\phi_i(f) = -2\pi f\frac{PD_i}{c}$$

$$\theta_i(f) = \phi_i(f) + \varphi_i(f)$$

The observed field due to the single source is then $$E_i(t,x,y)=Re\{\int A(f)\cdot\exp(j2\pi ft+j\beta(f))\cdot\exp(j\theta_i(f))df\}$$

The total observed field due to all the array elements is $$E(t, x, y) = \sum_{i=1}^{N} E_i(t, x, y)$$

$$= \sum_{i=1}^{N}\mathrm{Re}\left\{\int A(f)\cdot\exp(j2\pi ft + j\beta(f))\cdot\exp(j\theta_i(f))df\right\}$$

$$= \mathrm{Re}\left\{\int A(f)\cdot\exp(j2\pi ft + j\beta(f))\cdot\sum_{i=1}^{N}\exp(j\theta_i(f))df\right\}$$

where the linear operators Re{.}, summation and integration have been interchanged. The final summation term may be expressed as $$\sum_{i=1}^{N}\exp(j\theta_i(f)) = \sum_{i=1}^{N}(\cos(\theta_i(f)) + j\sin(\theta_i(f)))$$

$$= \sum_{i=1}^{N}\cos\theta_i(f) + j\sum_{i=1}^{N}\sin\theta_i(f)$$

$$= V(f) + jU(f)$$

where the functions U and V have been defined as $$V(f) = \sum_{i=1}^{N}\cos\theta_i(f)$$

$$U(f) = \sum_{i=1}^{N}\sin\theta_i(f)$$

The total field at position (x,y) is then $$E(t, x, y) = \mathrm{Re}\left\{\int A(f)\cdot\exp(j2\pi ft + j\beta(f))\cdot(V(f) + jU(f))df\right\}$$

$$= \mathrm{Re}\left\{\int A(f)\cdot[\cos(2\pi ft + \beta(f)) + j\sin(2\pi ft + \beta(f))]\cdot[V(f) + jU(f)]df\right\}$$

$$= \int A(f)\cdot[V(f)\cos(2\pi ft + \beta(f)) - U(f)\sin(2\pi ft + \beta(f))]df$$

It is seen that the total field is the sum of in-phase and quadrature components at each frequency f. This expression can be reformulated in terms of a single carrier with suitable amplitude and phase delay as follows $$V(f)\cos(2\pi ft + \beta(f)) - U(f)\sin(2\pi ft + \beta(f)) = AV(f)\cdot\cos(2\pi ft + \beta(f) + \Phi(f))$$

$$AV(f) = \sqrt{U^2(f) + V^2(f)}$$

$$\Phi(f) = \arctan\left(\frac{U(f)}{V(f)}\right)$$

so that $$E(t,x,y)=\int A(f)\cdot AV(f)\cdot\cos(2\pi ft+\beta(f)+\Phi(f))df$$

We aim to apply the ventriloquial field principle on a frequency by frequency basis. For a particular frequency, an equiphase wavefront is established between the points (x,y) and (x+dx,y) by requiring that $$\Phi(f,x,y)=\Phi(f,x+dx,y)$$

$$\approx\Phi(f,x,y)+dx\cdot\partial\Phi(f)/\partial x$$

which in turn implies $$\partial\Phi(f)/\partial x=0$$

Using the same process derived in previous chapters, this requirement imposes the following condition on the choice of the angles $\theta_i$ (f)

$$C1(\theta_1(f), \theta_2(f), \ldots, \theta_N(f)) = 0$$

$$= \sum_{i=1}^{N}\sum_{j=1}^{N}\frac{(x - x_j)}{PD_j(x, y)}\cdot\cos(\theta_i(f) - \theta_j(f))$$

It is important to note that the only frequency dependent term in the condition are the angles $\theta_i$ (f).

It follows that if a set of solution angles $\theta_i$ ($f_1$) may be identified which satisfy the anomaly condition at the angle $f_1$, they will also satisfy the anomaly condition at all other frequencies.

Hence it is possible to set these angles to the same values for all frequencies $$\theta_i(f_1)=\theta_i(f)=\theta_i\forall f$$

This in turn implies that the functions U(f) and V(f) will have the same values for all values of f, as will the functions AV(f) and Φ(f).

$U(f)=U\forall f$ $V(f)=V\forall f$ $\Phi(f)=\Phi\forall f$ $AV(f)=AV\forall f$

The total field at position (x,y) and (approximately) at position (x+dx,y) will then be $$E(t,x,y)=AV\int A(f)\cdot\cos(2\pi ft+\beta(f)+\Phi)df$$

As will be demonstrated in section 8.2.2, the angles $\theta_i$ may also be chosen so that $$\Phi(x,y)=\Phi(x+dx,y)=0$$

without losing the ventriloquial property. Thus the field experienced at (x,y) and (approximately) at position (x+dx,y) will be $$E(t,x,y)=AV\int A(f)\cdot\cos(2\pi ft+\beta(f))df$$
$$=AV\cdot s(t)$$

All that remains to be established is the exact form of the signals which must be transmitted at each source. Recall that $$\phi_i(f)=-2\pi f\frac{PD_i}{c}$$
$$\theta_i=\phi_i(f)+\varphi_i(f)$$

Once the solution angles $\theta_i$ have been selected to satisfy the anomaly condition, it follows that $$\varphi_i(f)=\theta_i-\phi_i(f)$$
$$\therefore\varphi_i(f)=\theta_i+2\pi f\frac{PD_i}{c}$$

This allows the computation of the start phases for each transducer's signal. The actual time domain signal to be transmitted is then $$s_i(t)=Re\{\int A(f)\cdot\exp(j2\pi ft+j\beta(f)+j\phi_i(f))df\}$$

In practice, this signal would be synthesised by replacing the continuous integral with a discrete summation. Appropriate phases and amplitude weightings for each frequency bin would be generated, and the time domain signal would be generated by applying an inverse FFT.

This result indicates that it is possible to generate an acoustic field anomaly for a broad band signal. Indeed the signal experienced simultaneously at position (x,y) and (approximately) at position (x+dx,y) will be whatever signal s(t) has been selected for use in countermeasures.

Thus, a listening device in the anomaly region would hear
- the signal s(t) (which has been chosen for suitable decpetive properties)
- the signal s(t) as approaching from a direction other than from the true signal source Hence both the content of the signal, and its apparent direction of arrival may be engineered to deceive a listening device at the anomaly.

5.1.7 Improvement to Field Amplitude at Anomaly

The amplitudes of the field in the anomaly region at the target location, calculated using the condition function hereto described, are at levels well below that of the sources. The field anomaly is created when the field is very close to absolute destructive interference.

This constitutes a problem, as there is little point in creating an anomaly if it is too faint to have any misleading effect on any hostile acoustic sensor. A number of approaches have been identified to improve the amplitude level at this field point.

The first uses an iterative numerical technique which attempts to simultaneously increase the amplitude function, while improving the degree to which the equiphase condition is satisfied. This technique will be described later.

A further approach uses a divide and rule approach to boosting the anomaly amplitude. A multi-sensor transducer sensor is split into multiple groups of transducers and each transducer group is tuned to create a field anomaly at the chosen field point. The effect of all groups transmitting simultaneously is for all of their fields to superimpose on one another. Since each group creates a field with equal phase at the anomaly point, their amplitudes will add coherently, thus improving the field amplitude.

This approach will be described later.

5.1.8 Method for Improvement of Field Amplitude at Anomaly 5.1.8.1 Introduction

Recall that the condition for establishing a VAF anomaly at location (x,y) is $$0=\sum_{i=1}^{N}\sum_{j=1}^{N}g(i,k)\cdot\cos(\theta_i-\theta_j)$$

This equation is solved by finding suitable values for the angles $\theta_i$ i=1, 2, . . . , N. Consider the lowest order system possible, where the number of source transducers N=3. As discussed previously we have control over the two free variables ($\theta_2$, $\theta_3$) to satisfy this single equation.

$$C1(\theta_2,\theta_3)=\sum_{i=1}^{N}\sum_{j=1}^{N}g(i,k)\cdot\cos(\theta_i-\theta_j)=0$$

Clearly, there is scope to glean some advantage from the second independent variable over which we have control.

5.1.8.2 Direct Augmentation of Field Amplitude

An iterative algorithm for improving the solution to the equation C1=0 may be found by investigating the first order Taylor series for the function $C1(\theta_2,\theta_3)$ $$C1(\theta_2+\Delta\theta_2,\theta_3+\Delta\theta_3)\approx C1(\theta_2,\theta_3,\epsilon)+\partial C1/\partial\theta_2\Delta\theta_2+\partial C1/\partial\theta_3\Delta\theta_3=0\therefore\partial C1/\partial\theta_2\Delta\theta_2+\partial C1/\partial\theta_3\Delta\theta_3\approx-C1(\theta_2,\theta_3)$$

In parallel to improving the solution to the equation C1=0 by identifying offsets ($\Delta\theta_2$, $\Delta\theta_3$) to the solution ($\theta_2$, $\theta_3$), let us also investigate the behaviour of the field amplitude function when these offsets are added.

$$A(\theta_2+\Delta\theta_2,\theta_3+\Delta\theta_3)\approx A(\theta_2,\theta_3,\epsilon)+\partial A/\partial\theta_2\Delta\theta_2+\partial A/\partial\theta_3\Delta\theta_3$$

Let us attempt to boost the amplitude by a factor $\tau$, so that $$A(\theta_2+\Delta\theta_2,\theta_3+\Delta\theta_3)\approx(1+\tau)A(\theta_2,\theta_3,\epsilon)$$

It follows then that $$A(\theta_2+\Delta\theta_2,\theta_3+\Delta\theta_3)\approx A(\theta_2,\theta_3)+\frac{\partial A}{\partial\theta_2}\Delta\theta_2+\frac{\partial A}{\partial\theta_3}\Delta\theta_3$$
$$=(1+\tau)\cdot A(\theta_2,\theta_3)$$
$$\therefore \tau\cdot A(\theta_2,\theta_3)$$
$$=\frac{\partial A}{\partial\theta_2}\Delta\theta_2+\frac{\partial A}{\partial\theta_3}\Delta\theta_3$$

The equations for improving the solutions performance can be expressed in matrix format as $$\begin{bmatrix}\frac{\partial C1}{\partial\theta_2} & \frac{\partial C1}{\partial\theta_3}\\ \frac{\partial A}{\partial\theta_2} & \frac{\partial A}{\partial\theta_3}\end{bmatrix}\begin{bmatrix}\Delta\theta_2\\ \Delta\theta_3\end{bmatrix}=\begin{bmatrix}-C1\\ \tau\cdot A\end{bmatrix}$$

which may be solved as $$\begin{bmatrix}\Delta\theta_2\\ \Delta\theta_3\end{bmatrix}=\begin{bmatrix}\frac{\partial C1}{\partial\theta_2} & \frac{\partial C1}{\partial\theta_3}\\ \frac{\partial A}{\partial\theta_2} & \frac{\partial A}{\partial\theta_3}\end{bmatrix}^{-1}\begin{bmatrix}-C1\\ \tau\cdot A\end{bmatrix}$$

5.1.8.3 Evaluation of Matrix Coefficients

The coefficients of the matrix are simply the first order partial derivatives of the functions C1 and A with respect to the free variables $\theta_2$ and $\theta_3$.

Recall that these derivatives may be computed analytically. The forms of these derivatives are restated for convenience.

$$\frac{\partial C1}{\partial\theta_p}=\sum_{i\neq p}(g(i,p)+g(p,i))\cdot\sin(\theta_i-\theta_p)$$

$$\frac{\partial A}{\partial\theta_p}=2\sum_{i=1}^{N}\sin(\theta_i-\theta_p)$$

5.1.8.4 Choice of Amplitude Improvement Factor 'τ'

The factor 'τ' has been incorporated into our update equations to allow control over the degree of desired improvement in field amplitude.

If the functions A and C1 were linear functions of ($\theta_2$, $\theta_3$), the Taylor series approximations would be exact representations of the behaviour of these functions at a small offset ($\Delta\theta_2$, $\Delta\theta_3$) from the original point ($\theta_2$, $\theta_3$). Under these circumstances, we could easily let τ=1, so that in a single step we would double the amplitude level, and obtain a perfect solution to C1=0.

However the functions A and C1 are very non-linear in ($\theta_2$, $\theta_3$). Iterating with a fixed value for τ leads to behaviour where the generated values ($\theta_2+\Delta\theta_2$, $\theta_3+\Delta\theta_3$) overshoot the zero of C1.

To overcome this, the algorithm must reduce its 'ambitiousness' towards improving A when the solution ($\theta_2$, $\theta_3$) is in a neighbourhood where the function C1 is very sensitive. A simple rule which implements this is to reduce τ if the previous iteration resulted in an increase to the magnitude C1.

5.1.8.5 Summary of Method

A single iteration step of the algorithm is as follows

With the current solution set ($\theta_2$, $\theta_3$) compute the functions C1 and A If the magnitude of the new value for C1 exceeds that computed at the last iteration, reduce 'ambition' factor τ.

With the current solution set ($\theta_2$, $\theta_3$), use the analytical expression for the partial derivatives of C1 and A to compute the matrix coefficients.

Solve the matrix equation for solution offsets ($\Delta\theta_2$, $\Delta\theta_3$)

Add the solution offsets ($\Delta\theta_2$, $\Delta\theta_3$) to current solution set ($\theta_2$,$\theta_3$), to obtain next solution set ($\theta_2$, $\theta_3$)

This process may be repeated any number of times until some metric of solution 'goodness' is satisfied.

5.1.8.6 Observed Performance of Direct Amplitude Augmentation Algorithm

The algorithm outlined in the previous sections has been implemented in a host environment using the following parameters

| | |
|---|---|
| wavelength | 2 |
| anomaly location | (4, 20) |
| anomaly angle | 10 |
| source locations | (−1, 0), (0, 0), (1, 0) |

The results indicated that the algorithm has identified a solution in which the amplitude is significantly increased at the anomaly location of the order of 25 dB, which is a very satisfactory result.

5.1.9 Improvement of Field Amplitude at Anomaly by Superposition 5.1.9.1 Introduction The preceding sections have dealt with methods for improving the amplitude at an anomaly generated by the use of three source transducers. Where active transducer arrays with more than three elements are available, it becomes feasible to instead use the principle of superposition to improve field strength.

This approach may be viewed as utilizing the surplus degrees of freedom afforded by a multi-transducer array to achieve a better amplitude outcome.

There are two different methods by which the multi-sensor array can be broken down. These are described in the following sections.

5.1.9.2 Array of VAF Groups 5.1.9.3 Introduction

Figure 3:
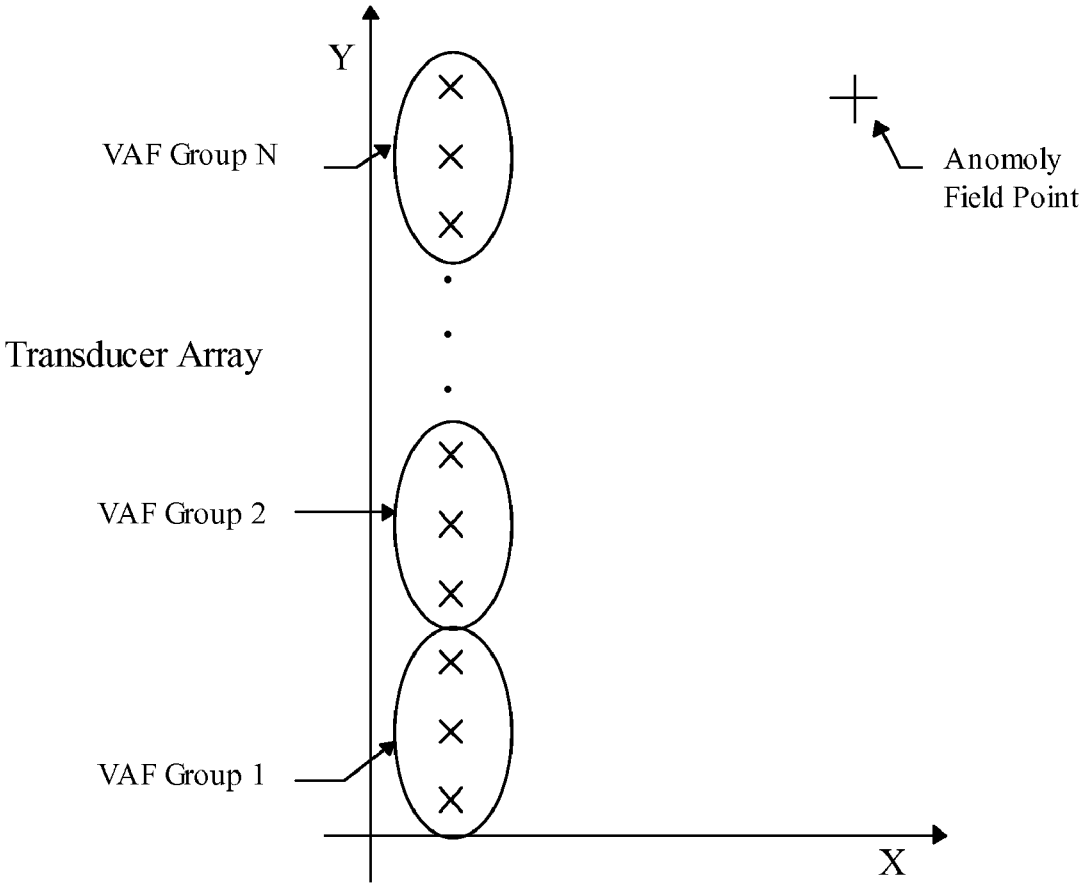
FIG. 3 depicts a number of field sources grouped into a plurality of groups for purposes of explaining an embodiment of the present invention.

The principle will be explained with reference to FIGS. 3 to 6. With reference to FIG. 3, the sensor is broken up into multiple groups, with each group comprising three elements. Each group is solved independently to produce a field anomaly at the desired point.

Figure 4:
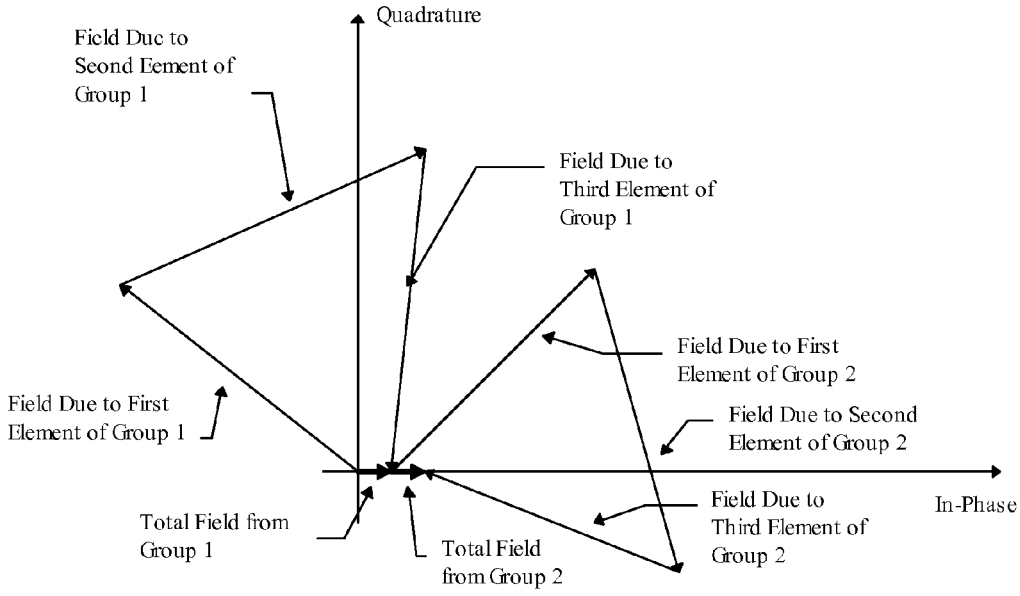
FIG. 4 is a depicts the superposition of fields from separate groups of sources in order to illustrate that while each group is close to destructive interference internally, constructive interference is in evidence between groups.

As has been seen previously, the field produced within a single group has a form very near to destructive interference. However, if we arrange the total output field from each group carefully, we can ensure that these group fields add constructively between groups. This is shown in FIG. 4, where it can be seen that although each group is close to destructing interference internally, constructive interference occurs between groups. The key to ensuring that the fields from the various groups are made to add constructively, lies with the phase of the total field produced by each group. Consider the examples depicted in FIG. 4. The broken lines represent the field vector (amplitude+phase) produced at the anomaly position, by a particular transducer within a group. The heavy lines represent the total field for a group, and are the result of the vector addition of the contributions from each transducer within that group. Two groups are depicted in this diagram, and both groups total output field have been drawn as having zero phase; ie, the heavy vectors are parallel to the in-phase axis. Because both of these heavy vectors have the same phase, they add constructively.

5.1.9.4 Generating Groups with Total Field Phase of Zero

It is possible to ensure that the total field for a group does have zero phase. Let us assume that a VAF solution has been found for a particular group of three transducers. The solution set of angles ($\theta_1$, $\theta_2$, $\theta_3$) might yield a total field with an arbitrary phase. This situation is depicted in FIG. 5.

Figure 5:
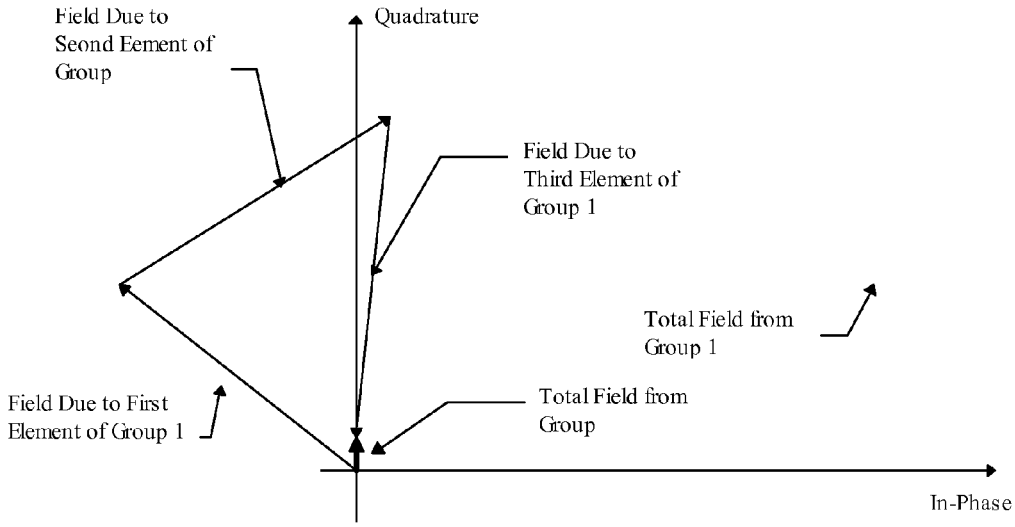
FIG. 5 depicts the field from a group which results in a total field with non-zero phase.

The example illustrated in FIG. 5 has a total field with phase 90 degrees. More generally, the total field will be:

$$\Phi = \arctan\left(\frac{U}{V}\right) = \arctan\left(\frac{\sum_{i=1}^{N}\sin(\theta_i)}{\sum_{i=1}^{N}\cos(\theta_i)}\right)$$

Recall that the condition for a field anomaly is $$0 = \sum_{i=1}^{N}\sum_{j=1}^{N} g(i,k)\cdot\cos(\theta_i - \theta_j)$$

and note that the solution depends only on the differences between the angles $\theta_i$. Consequently, it is possible to arrive at another set of angles $\theta_i'$ which also satisfy the above condition.

$$\theta_i' = \theta_i + \beta$$

where $\beta$ is any angle.

Note that $$\theta_i' - \theta_k' = \theta_i + \beta - \theta_k - \beta = \theta_i - \theta_k$$

so this new set of angles also satisfies the anomaly condition.

This property can be used to obtain a new solution set $\theta_i'$ which satisfies the anomaly condition, and which yields a total field phase of zero, by setting $\beta = -\Phi$.

Figure 6:
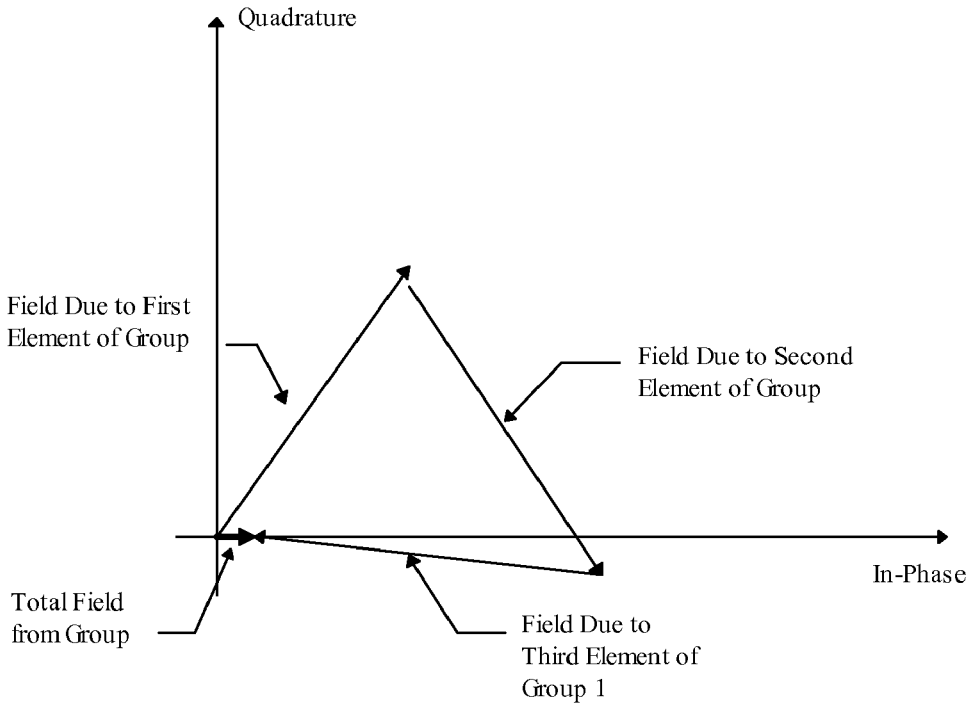
FIG. 6 depicts a rotation of field phases within a group so that resulting total field phase is zero.

FIG. 6 illustrates how the new solution mirrors the original solution, but yields a total field phase of zero degrees.

5.1.9.5 Summary of Algorithm for Array of VAF Approach

The use of multiple groups to generate anomalies which add constructively may be summarised as follows:

1. For the first group, obtain a solution set ($\theta_1$, $\theta_2$, $\theta_3$) to anomaly condition
2. From this solution set, compute total field phase $\Phi$ for group
3. Generate equivalent solution set ($\theta_1'$,$\theta_2'$, $\theta_3'$) by subtracting $\Phi$ from each angle
4. Repeat for each group within sensor 5.1.10 Achievable Amplitude Levels The results of the previous sections may now be combined in a realistic example.

Consider an array of 16 elements, each of which can produce phase stable signals at a source level of 190 dB re 1 μP at 1 meter. This is typical of what is currently achievable with modern towed low frequency active systems.

The array is split into 5 groups of 3 elements each. Each group is programmed by the direct amplitude augmentation method to create an anomaly at a distance of approximately 20 m from the array. From the results of section 7.6, an anomaly at this distance will have an amplitude level approximately 70 dB below source level. The five groups will independently create anomalies, each of which will be tuned so that the total fields combine coherently. This will lead to a gain in the amplitude level at the anomaly of 20 log(5)=14 dB.

The total amplitude level at the anomaly will hence be 190−70+14=134 dB. This level may be considered to be well in excess of the background noise level. Consequently, any listening device at this position will hear a 'loud' target coming from a direction other than own ship, which will achieve the basic objective of this technique.

It is useful to compare this signal level to that achievable with the same array operating in phased transmission; i.e. conventional mode. Such a beamformer would experience a gain from the coherent addition of all sensor signals, This gain may be evaluated as 20 log 16. The propagation loss (spherical) to the position 20 m distant from the array would be −20 log 20.

The (conventional) signal level would thus be 190+24−26=188 dB. Note that this is 54 dB greater than the field level for the anomaly. Hence it is evaluated that the creation of the ventriloquial acoustic field 'costs' 54 dB of power level.

5.2 Exemplary Embodiment No. 1

Narrowband VEF System

Figure 7:
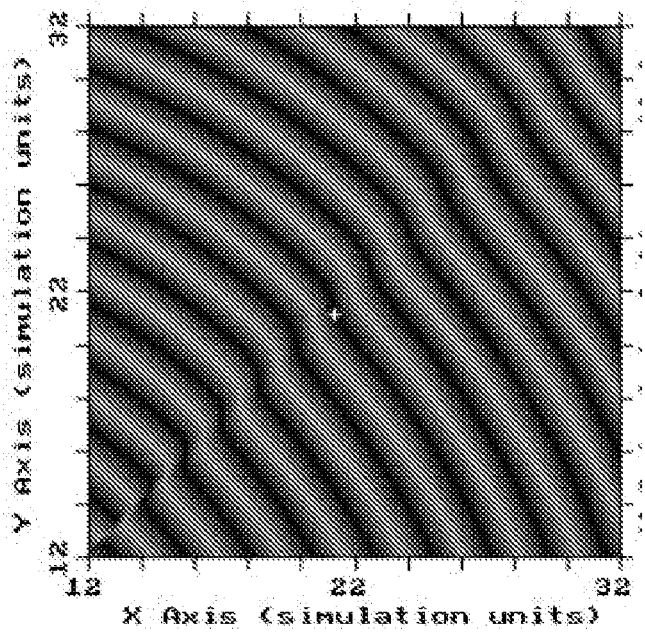
FIG. 7 is a phase plot of a field produced in accordance with an embodiment of the present invention.
Figure 8:
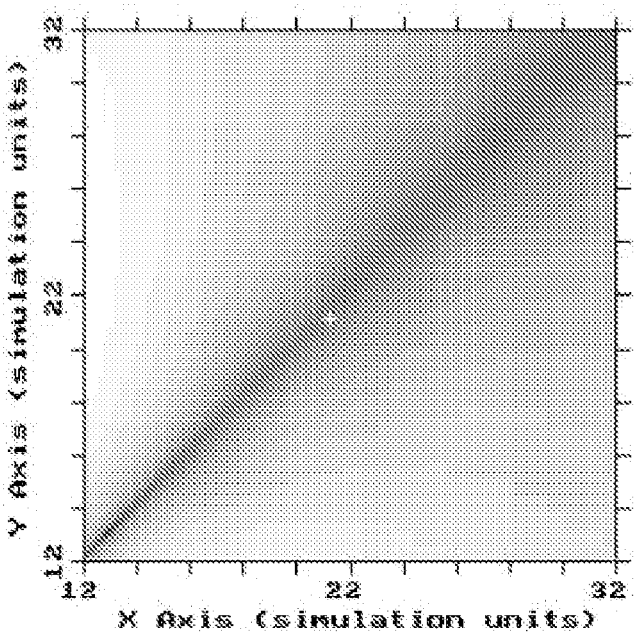
FIG. 8 is an amplitude plot corresponding to the phase plot of FIG. 7.

FIGS. 7 and 8 illustrate the amplitude and phase patterns of a Narrowband VFA created by a processing system (item 2 of FIG. 11) programmed to implement an method that will be described shortly. The processing system produces signals to drive an array containing three sources (items 32, 34 and 36) of FIG. 11, spaced 1 m apart spread evenly along the x axis at the origin. The wavelength of the emission is 2 m. The VFA location is at 45 degrees to the axis. However, from FIGS. 7 and 8 it is apparent that the VFA effect is not limited to this location, but occurs along a radial line. Also, note from the amplitude plot of FIG. 8, that the VFA effect occurs at conditions close to destructive interference, i.e. in a dark region of the plot.

The following method enables the establishment of a narrowband VFA at a nominated target location (x,y). The signal present in the field will be a single frequency tonal signal.

In order to implement the narrowband VEF system an emitter is employed that contains three or more sources at known locations. Each source is capable of emitting a signal (whether acoustic or electromagnetic) into a substantially homogenous medium such as seawater or the atmosphere.

The signal transmitted at each source is a single frequency tonal signal. The signal transmitted at the $i^{th}$ transducer is a single frequency tonal signal having an amplitude A, phase $\phi_i$ and frequency t as follows:

$$s_i(t) = Ae^{\phi_i}\cos 2\pi ft$$

The frequency and amplitude of the signals emitted at each source is the same, but the phase of the signal at each source is independently controllable.

The variables and parameters that will be referred to in describing the Narrowband VEF method are as follows:

N The number of sources. N must be greater than or equal to 3.

i,j indexes.

$(x_i,y_i)$ Location of the $i^{th}$ transducer. Dimensional units are meters.

f The frequency (in Hz) of the narrowband signal at each emitter.

A The amplitude for all narrowband signals at the emitters.

$\phi_i$ The phase (in radians) of the narrowband signal emitted by the $i^{th}$ transducer.

$s_i(t)$ The signal transmitted by the $i^{th}$ transducer.

c The speed of propagation of signals in the homogenous medium.

(x,y) Target location to create a Ventriloquial Field Anomaly (VFA)

$\chi$ Desired angle (relative to x axis) of the wavefront to be created at the target location.

$\delta$ A convergence parameter that should be set to a very small quantity, e.g. 10E-12.

5.2.1 VEF Narrowband Method

The VEF technique for the Narrowband VEF System requires the determination of the phases $\phi_i$ for each source emitter. The following steps 1A to 1L. set out a method for determining the $\phi_i$ according to an embodiment of the present invention.

1A. Rotate all Locations.

The locations are rotated through the angle $\chi$ about the origin of the Cartesian coordinate system by performing the following matrix multiplication on the VFA location (x,y) and each of the N locations $(x_i,y_i)$ of the emitters.

$$\begin{bmatrix} x_{new} \\ y_{new} \end{bmatrix} = \begin{bmatrix} \cos\chi & \sin\chi \\ -\sin\chi & \cos\chi \end{bmatrix} \begin{bmatrix} x_{old} \\ y_{old} \end{bmatrix} \quad \text{(eqn. I)}$$

1B. Calculate all Path Differences

This step requires computation of the distance between the VFA location (x,y) and each of the N locations $(x_i,y_i)$ of the emitters.

$$PD_i = \sqrt{(x-x_i)2+(y-y_i)^2} \quad \text{(eqn. II)}$$

i=1, 2 . . . N

1C. Compute Variable g

This step requires the creation of an array of variables g(i,j) as follows:

$$g(i, j) = \frac{(x - x_j)}{PD_i(x, y)} \quad \text{(eqn. III)}$$

$$i, j = 1, 2, \ldots N$$

1D. Initialise Angular Variables of Each Emitter

This step creates angular variables $\theta_i$ associated with each of the N emitters and initialized to zero as follows:

$$\theta_i = 0;\ i = 1, 2, \ldots N$$

1E. Set Argument Counter

This step sets an argument counter p.

$$p = 2$$

1F. Compute Condition Function

This step computes the value of a condition function C1. To create a VFA this function needs to equal zero.

$$C1(\theta_1, \theta_2, \ldots, \theta_N) = \sum_{i=1}^{N} \sum_{j=1}^{N} g(i, j) \cdot \cos(\theta_i - \theta_j) \quad \text{(eqn. IV)}$$

1G. Determine Convergence Condition

This step compares the magnitude of C1 to a convergence parameter in order to determine whether further iterations are required to reduce C1 to a value sufficiently close to zero.

If ($|C1|<\delta$) goto step 1L else continue.

1H. Compute Partial Derivative Function

This step computes the partial derivatives of the condition function C1 (eqn. IV) with respect to $$\frac{\partial C1}{\partial \theta_p} = \sum_{i \neq p} (g(i, p) + g(p, i)) \cdot \sin(\theta_i - \theta_p) \quad \text{(eqn. V)}$$

1I. Compute Angle Update

This step computes the required adjustment of angle $\theta_p$ $$0 = C1(0, \theta_2, \theta_3, \ldots, \theta_p, \ldots, \theta_N) + d\theta p \cdot \frac{\partial C1}{\partial \theta_p}$$

$$\therefore d\theta p = -\frac{C1(0, \theta_2, \theta_3, \ldots, \theta_p, \ldots, \theta_N)}{\frac{\partial C1}{\partial \theta_p}} \quad \text{(eqn. VI)}$$

1J. Update Angle $$\theta_p := \theta_p + d\theta_p$$

1K. Cycle Through Angles and Repeat set p:=p+1 if (p>N) set p:=2

Goto step F.

1L. Deduce Source Phase Angles

This step determines the source phase angles.

$$\phi_i = \theta_i + (2\pi f^{PDi/c}) \quad \text{(eqn. VII)}$$

END Method No. 1

5.3 Exemplary Embodiment No. 2

Augmented Amplitude Narrowband VEF System

The VFA that is generated by use of the Augmented Amplitude Narrowband method occurs in conditions of destructive interference. That is, the amplitude of the field at the VFA location is very small compared to the amplitude, A, of the signal transmitted at each of the sources. Nevertheless in comparison to the previously described non-augmented method, the augmented amplitude method leads to the power of the field at the VFA being substantially higher. As previously discussed, experiments indicate an improvement in the order of 25 dB over the VFA experienced at the target in comparison to the non-augmented method.

Figure 9:
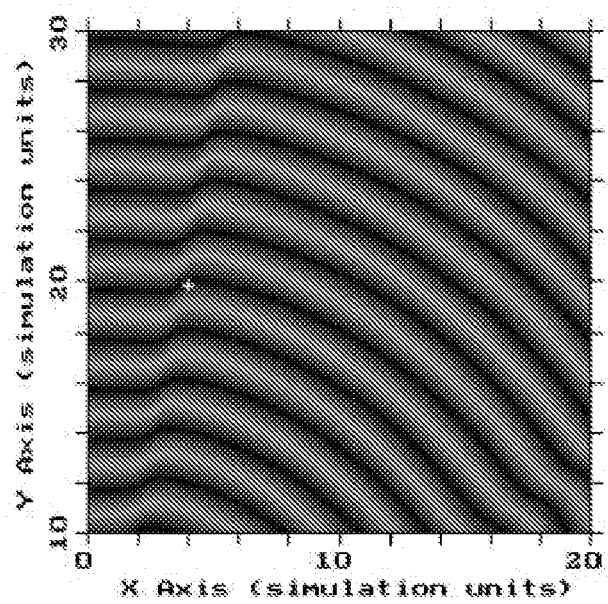
FIG. 9 is a phase plot of a field produced in accordance with a further embodiment of the present invention.
Figure 10:
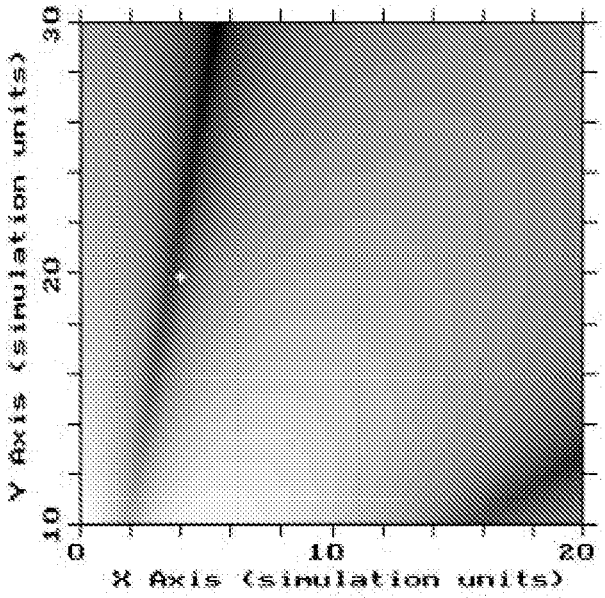
FIG. 10 is an amplitude plot corresponding to the phase plot of FIG. 9.

FIGS. 9 and 10 illustrate the phase and amplitude patterns created using the augmented amplitude method that will shortly be explained. The VFA characteristic is clearly evident in the phase plot of FIG. 9. The amplitude plot of FIG. 10 indicates that while the VFA still occurs near destructive interference, as previously discussed the level of field is substantially improved.

The following method enables the establishment of an augmented narrowband VFA at a nominated target location (x,y). The signal present in the field will be a single frequency tonal signal.

In order to implement the narrowband VEF system an emitter is employed that contains three or more sources at known locations. Each source is capable of emitting a signal (whether acoustic or electromagnetic) into a substantially homogenous medium such as seawater or the atmosphere.

The signal transmitted at each source is a single frequency tonal signal. The signal transmitted at the $i^{th}$ transducer is a single frequency tonal signal having an amplitude A, phase $\phi_i$ and frequency t as follows:

$$s_i(t)=Ae^{\phi_i}\cos 2\pi ft$$

The frequency and amplitude of the signals emitted at each source is the same, but the phase of the signal at each source is independently controllable.

The variables and parameters that will be referred to in describing the augmented Narrowband VEF method are as follows:

N The number of sources. N must be greater than or equal to 3.

i,j indexes.

$(x_i,y_i)$ Location of the $i^{th}$ transducer. Dimensional units are meters.

f The frequency (in Hz) of the narrowband signal at each emitter.

A The amplitude for all narrowband signals at the emitters.

$\phi_i$ The phase (in radians) of the narrowband signal emitted by the $i^{th}$ transducer.

$s_i(t)$ The signal transmitted by the $i^{th}$ transducer.

c The speed of propagation of signals in the homogenous medium.

(x,y) Target location to create a Ventriloquial Field Anomaly (VFA)

$\chi$ Desired angle (relative to x axis) of the wavefront to be created at the target location.

$\delta$ A convergence parameter that should be set to a very small quantity, e.g. 10E-12.

$\tau$ An 'ambition' factor initially set to 1.

5.3.1 Augmented Amplitude Narrowband VEF Method

The following steps describe how the phases of the signals applied to each of the sources are determined.

2A. Rotate all Locations.

The locations are rotated through the angle $\chi$ about the origin of the Cartesian coordinate system by performing the following matrix multiplication on the VFA location (x,y) and each of the N locations $(x_i,y_i)$ of the emitters.

$$\begin{bmatrix} x_{new} \\ y_{new} \end{bmatrix} = \begin{bmatrix} \cos\chi & \sin\chi \\ -\sin\chi & \cos\chi \end{bmatrix} \begin{bmatrix} x_{old} \\ y_{old} \end{bmatrix} \quad \text{(eqn. I)}$$

2B. Calculate all Path Differences

This step requires computation of the distance between the VFA location (x,y) and each of the N locations $(x_i,y_i)$ of the emitters.

$$PD_i=\sqrt{(x-x_i)^2+(y-y_i)^2} \quad \text{(eqn. II)}$$

i=1, 2 . . . N

2C. Compute Variable g

This step requires the creation of an array of variables g(i,j) as follows:

$$g(i,\ j) = \frac{(x - x_j)}{PD_i(x,\ y)} \quad \text{(eqn. III)}$$

$$i,\ j = 1, 2, \ldots N$$

2D. Initialise Angular Variables of Each Emitter

This step creates angular variables $\theta_i$ associated with each of the N emitters and initialized to zero as follows:

$$\theta_i=0;\ i=1, 2, \ldots N$$

2E. Initialise Condition Function Limit $C1_prev=1\times10^{15}$

2F. Compute Condition Function

This step computes the value of a condition function C1. To create a VFA this function needs to equal zero.

$$C1(\theta_2,\ \theta_3) = \sum_{i=1}^{N}\sum_{j=1}^{N} g(i,\ j)\cdot\cos(\theta_i - \theta_j) = 0 \quad \text{(eqn. IV)}$$

2G. Determine Convergence Condition

This step compares the magnitude of C1 to a convergence parameter in order to determine whether further iterations are required to reduce C1 to a value sufficiently close to zero.

If ($|C1|<\delta$) goto step (13) else continue.

2H. Determine Adjustment to Ambition Factor

This step determines whether the method should reduce the level of ambition on each iteration.

If ($|C1|>|C1_prev|$) then set $\tau:=\tau\times0.9$

Set C1_prev=C1.

2I. Compute Complex Field Components at VFA Location

This step requires the computation of the real and imaginary components of the field at the VFA.

$$V(x,\ y) = RL\left\{\sum_{i=1}^{N} e^{j\theta_i}\right\} = \sum_{i=1}^{N}\cos(\theta_i) \quad \text{(eqn. V)}$$

$$U(x,\ y) = IM\left\{\sum_{i=1}^{N} e^{j\theta_i}\right\} = \sum_{i=1}^{N}\sin(\theta_i) \quad \text{(eqn. VI)}$$

$$(n = 3)$$

2J. Compute Field Power at VFA Location

Compute the power of the field at the VFA target (x,y).

$$A=U_2+V^2 \quad \text{(eqn. VII)}$$

2K. Compute Partial Derivatives of Condition Function

Compute the partial derivatives of the Condition function and the Power function of the VFA.

$$\frac{\partial C1}{\partial\theta_p} = \sum_{i\neq p}(g(i,\ p) + g(p,\ i))\cdot\sin(\theta_i - \theta_p);\ p = 2,3 \quad \text{(eqn. VIII)}$$

2L. Compute Partial Derivatives of Field Power Function

Compute the partial derivatives of the Condition function and the Power function at the VFA.

$$\frac{\partial A}{\partial \theta_p} = 2\sum_{i=1}^{N} \sin(\theta_i - \theta_p);\ p = 2,3 \quad \text{(eqn. IX)}$$

2M. Compute Angle Update

Compute the required adjustment to the angles $\theta_2$ and $\theta_3$ $$\begin{bmatrix} \Delta\theta_2 \\ \Delta\theta_3 \end{bmatrix} = \begin{bmatrix} \frac{\partial C1}{\partial \theta_2} & \frac{\partial C1}{\partial \theta_3} \\ \frac{\partial C1}{\partial \theta_2} & \frac{\partial C1}{\partial \theta 3} \end{bmatrix}^{-1} \begin{bmatrix} -C1 \\ \tau \cdot A \end{bmatrix} \quad \text{(eqn. X)}$$

2N. Update Angle

This step adjusts the angles $\theta_p$p=2, 3

$$\theta_p := \theta_p + d\theta_p$$

2O. Repeat Iteration

Goto step 2F.

2P. Deduce Source Phase Angles

This step determines the source phase angles.

$$\phi_i = \theta_i + (2\pi f^{PDi/c})$$

END Method No. 2

5.4 Exemplary Embodiment No. 3

Multiple Group Amplitude Augmentation Narrowband VEF System

This embodiment of the invention makes use of a method that enables the establishment of a VFA at a nominated location. The signal present in the field will be a single frequency tonal signal.

This embodiment applies to a multiple element source, where the number of sources N is a multiple of 3.

The intent of the following method is to improve the amplitude level of the field experienced at the VFA target location.

The method involves dividing the sources into M groups of 3, so that N=3M.

Figure 2:
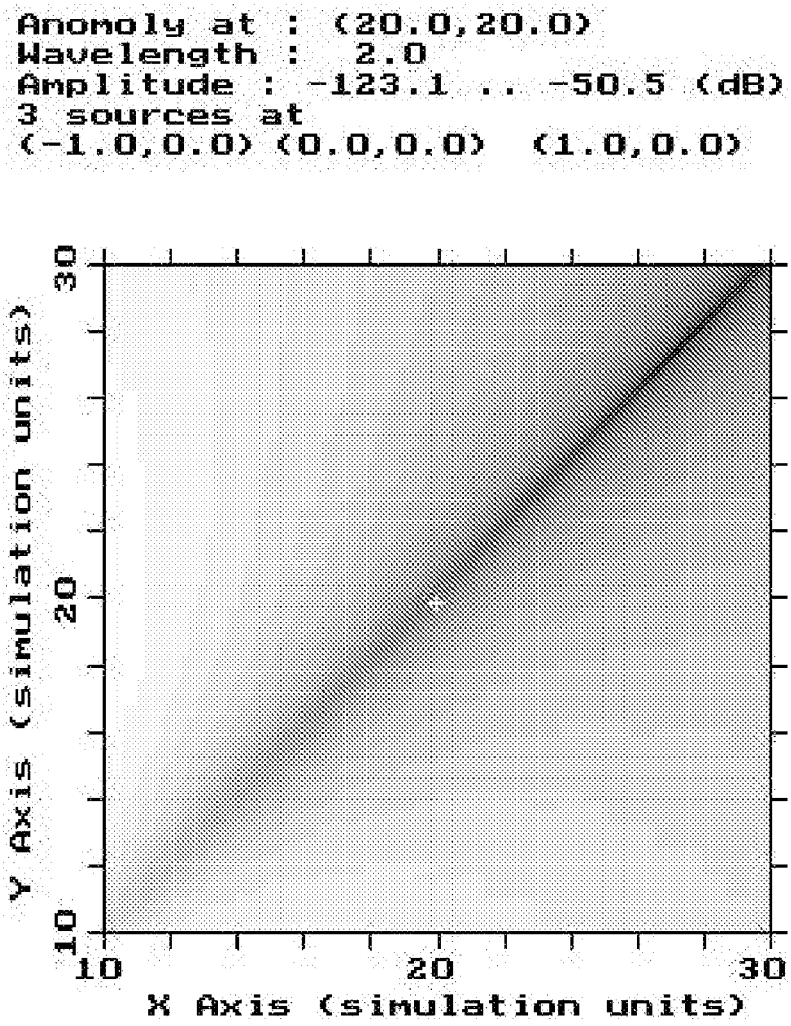
FIG. 2 is an amplitude plot corresponding to the field of FIG. 1.

FIG. 1 illustrates the partitioning of a multi-sensor array into M groups, each comprising 3 sources.

In order to implement the multiple group amplitude augmentation narrowband VEF method the system should include 3M sources at known locations. Each source is capable of emitting a signal (whether acoustic or electromagnetic) into a homogenous medium.

The signal transmitted at each source is a single frequency tonal signal. The frequency and amplitude of the signals emitted at each source is the same. The phase of the signal at each source is independently controllable.

The variables used are as follows:

M The number of groups of sources in array.

N The number of sources, where N=3M.

k Index to a group, k=1, 2, . . . , M $\Phi_k$ Phase of field at VFA target location produced by the $k^{th}$ group of sources The signal transmitted at the ith transducer is as follows:

$$s_i(t) = Ae^{\Phi i} \cos 2\pi f t$$

5.4.1 Multiple Group Amplitude Augmentation Narrowband VEF Method

The following method determines the phases $\phi_i$ at each source.

3A. Initialise Group Number

Set group number k:=1.

3B. Run VEF Method on Current Group

This is accomplished by passing the locations of the three sources in group 'k' as inputs to the method described in Exemplary Embodiment No. 2

The variables available at the solved (i.e. output) of this method are:

the path differences PD1, PD2, and PD3.

the three field angles $\theta_1$ (which will equal zero), $\theta_2$ and $\theta_3$.

the complex components U and V of the VFA field at the VFA target location.

3C. Deduce Phase of Contribution of Current Group

This is accomplished by computing the phase as follows:

$$\Phi_k = \text{ARCTAN}(U/V)$$

3D. Update Field Angles for Current Group

This is accomplished by adjusting the field angles as follows:

$$\theta_1 := \theta_1 - \Phi_k$$

$$\theta_2 := \theta_2 - \Phi_k$$

$$\theta_3 := \theta_3 - \Phi_k$$

3E. Deduce Source Phase Angles

This step determines the source phase angles for the three sources in the current group k.

$$\phi_i = \theta_i + (2\pi f^{PDi/c})$$

3F. Update Group Number

This step increments the next group, and checks to see if this is the last of the M groups.

$$k := k+1$$

If k≦M goto step B.

End—Method No. 3

5.5 Exemplary Embodiment No. 4

Broadband VEF System

This embodiment of the invention enables the establishment of a VFA at a nominated location. The signal present in the field at the VFA will be a broadband signal.

This embodiment of the invention requires the following preconditions be met:

i) An emitter is available that contains 3 sources at known locations.

ii) Each source is capable of emitting a signal (whether acoustic, or electromagnetic) into a homogenous medium.

iii) A nominal deceptive signal s(t) is available and known, and that has the following characteristics:

iv) s(t) is limited in time to a duration of T, so that s(t) is zero for time t<0 and t>T.

v) The spectrum S(f) of the signal has no DC content. i.e. S(0)=0.

vi) The spectrum S(f) of the signal is limited, so that no energy is present for frequencies above a nominal cutoff frequency.

vii) The signal transmitted at each source is a broadband signal.

viii) The signals emitted at each source is are independently controllable, and are capable of emitting signals of the spectrum of the deceptive signal.

The variables defined for this VEF technique are as follows:

t time (seconds)

$F_s$ Sampling Frequency (Hz)

L(i,j) Length between source i and j $L_{max}$ Maximum length of array. (M)

c propagation speed of signal in homogenous medium (m/s)
s(t) Deception signal, e.g. in an underwater application the deception signal might consist of whale noise.
s(n) Sampled deception signal
S(k) Digital Spectrum of deception signal
S(i,k) Digital Spectrum of source 'i' signal
s(i,n) sampled signal at source 'i'
N The number of samples used in analysis
k Reference to a frequency index.
Φ Nominal phase produced by the VFA analysis.

5.5.1 Broadband VEF System Method

The VEF technique for the Broadband VEF System requires the selection of phases $\phi_i$ at each source emitter for each frequency bin of the deception signal.

The following steps describe how these phases are selected.

4A. Deduce Inter-Element Distances of Array

This step involves determining the three lengths between each of the three sources $$L(1,2)=\sqrt{(x_1-x_2)^2+(y_1-y_2)^2}$$

$$L(1,3)=\sqrt{(x_1-x_3)^2+(y_1-y_3)^2}$$

$$L(2,3)=\sqrt{(x_2-x_3)^2+(y_2-y_3)^2}$$

4B. Deduce Maximum Traverse Length of Array

This step involves determining the greatest of the three lengths between each of the three sources.

$$L_{max}=\mathrm{MAX}[(L(1,2),L(1,3),L(2,3)]$$

4C. Choose $F_s$

A sampling frequency is chosen so that $F_s>2\times$ cutoff frequency. For underwater sonar applications bands of up to a few 10's of kHz are typical. For radar applications the cutoff frequency will typically be somewhere in the microwave band.

4D. Determine Analysis Length

This is accomplished by a value for N as follows.

$$N=\frac{2(T+L_{\max}/c)}{F_s}$$

N is then rounded up to the next power of 2.

4E. Sample Deception Signal

This is accomplished by determining the values of the signal s(t) at times t=n/Fs.

$$s(n)=s(t=n/Fs)\ n=0,1,\ldots,N-1$$

4F. Compute Digital Spectrum of Deception Signal

This is accomplished by using the Discrete Fourier Transform (an FFT may be used)

$$S(k)=\sum_{n=0}^{N-1}s(n)e^{-j2\pi nk/N}$$

4G. Run VEF Method on Current Group

This is accomplished by passing the locations of the three sources to the method described in exemplary embodiment No. 2.

The variables available at the solved (i.e. output) of this method are the path differences $PD_1$, $PD_2$ and $PD_3$.

the three field angles, $\theta_1$ (which will equal zero), $\theta_2$ and $\theta_3$.

the complex field components at the VFA, U and V.

4H. Deduce Phase of Contribution of Current Group

This is accomplished by computing the phase as follows:

$$\Phi_k=\mathrm{ARCTAN}(U/V)$$

4I. Update Field Angles for Current Group

This is accomplished by adjusting the field angles as follows $$\theta_1=\theta_1-\Phi_k$$

$$\theta_2=\theta_2-\Phi_k$$

$$\theta_3=\theta_3-\Phi_k$$

4J. Form Spectrum of Signal at Source 1

This is accomplished by computing the complex spectrum as follows:

$$S(1,k)=S(k)e^{j\theta_1+j2\pi F_s PD_1\frac{k}{Nc}}\ k=1,2,\ldots,N/2-1$$

4K. Form Spectrum of Signal at Source 2

This is accomplished by computing the complex spectrum as follows:

$$S(2,k)=S(k)e^{j\theta_2+j2\pi F_s PD_2\frac{k}{Nc}}\ k=1,2,\ldots,N/2-1$$

4L. Form Spectrum of Signal at Source 3

This is accomplished by computing the complex spectrum as follows:

$$S(3,k)=S(k)e^{j\theta_3+j2\pi F_s PD_3\frac{k}{Nc}}\ k=1,2,\ldots,N/2-1$$

4M. Form Digital Signal for Source 1

This is accomplished as follows (fast Fourier techniques may be used):

$$S(1,n)=\sum_{k=1}^{\frac{N}{2}-1}\mathrm{Re}\{S(1,k)e^{j2\pi nk/N}\};\ n=0,1,\ldots,N-1$$

4N. Form Digital Signal for Source 2

This is accomplished as follows (fast Fourier techniques may be used):

$$S(2,n)=\sum_{k=1}^{\frac{N}{2}-1}\mathrm{Re}\{S(2,k)e^{j2\pi nk/N}\};\ n=0,1,\ldots,N-1$$

4O. Form Digital Signal for Source 3

This is accomplished as follows (fast Fourier techniques may be used):

$$S(3,n)=\sum_{k=1}^{\frac{N}{2}-1}\mathrm{Re}\{S(3,k)e^{j2\pi nk/N}\};\ n=0,1,\ldots,N-1$$

End of Method No. 4

The VFA that is generated by use of this method creates a VFA with a wavefront skewed to the desired angle $\chi$. The signal perceived at the VFA will be the deception signal. As with all of the previously described embodiments of the invention, the method steps above are undertaken automatically on a suitably programmed computer. The resulting three digital signal sequences may then be played out of each source using a digital to analog converter, and an anti-aliasing filter with cut-off frequency equal to half of the sampling frequency.

5.6 Implementation of the Invention

Figure 11:
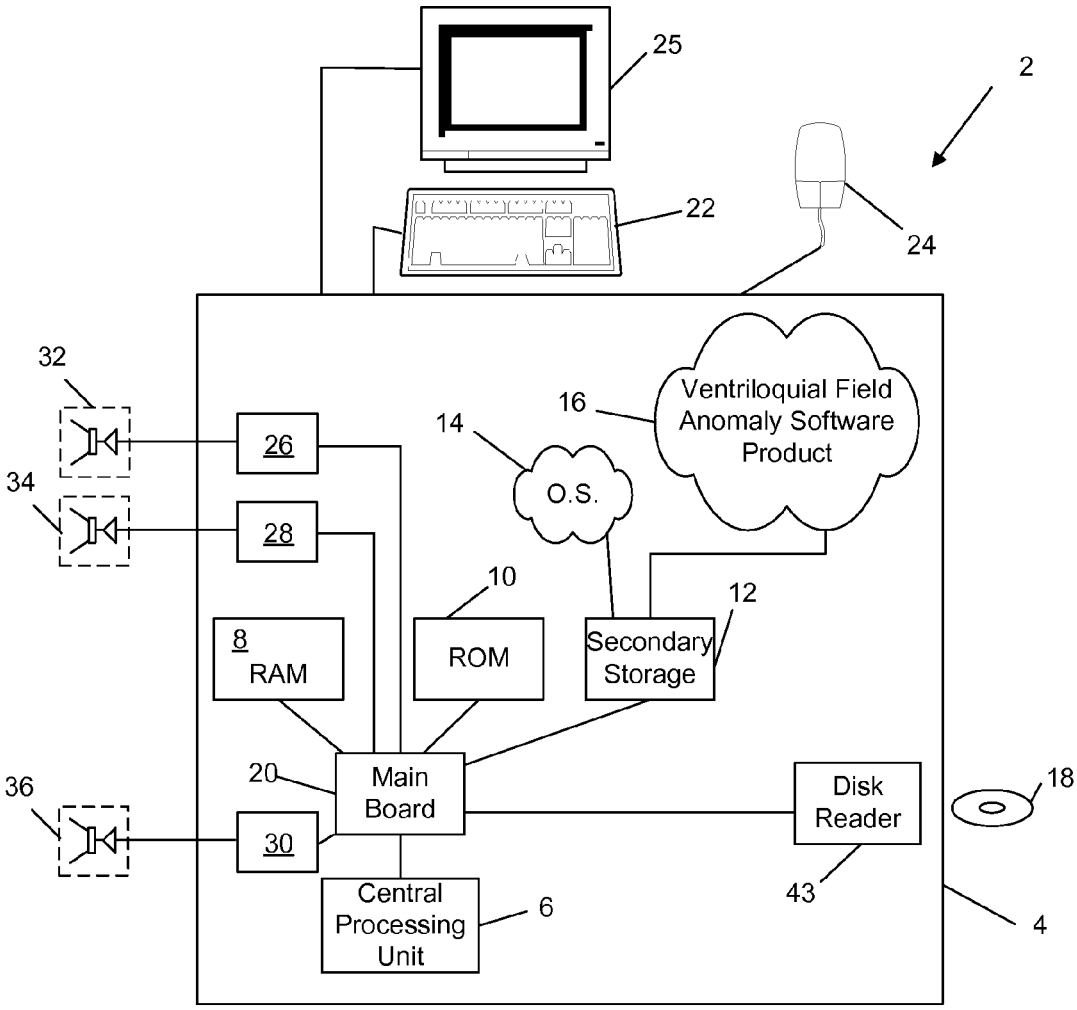
FIG. 11 is a schematic diagram of a computer system arranged to implement an embodiment of the present invention.

Referring now to FIG. 11, there is depicted a block diagram of a conventional computer system 2 of a type suitable for performing a method according to the various embodiments of the present invention. (A projectile defense system according to an embodiment of the invention will be described later in sections 6 and 7 and with reference to FIG. 12).

System 2 includes a computer case 4 which houses a processor 6 (or one or more processors) that accesses RAM 8, ROM 10 and various secondary data storage devices 12 such as hard disk drives. At start up the processor 6 loads an operating system 14 and subsequently executes a software product 16 loaded into RAM 8 from secondary storage 12. Software product 16 includes instructions for processor 6 to implement a method according to one of the embodiments of the present invention. The software product is typically provided on an optical or magnetically readable medium such as a CD-ROM 18, though it might also be provided in a ROM or other electronic circuit as firmware or downloaded over a computer network such as the Internet.

By means of conventional interfacing circuitry located on a mainboard 20 the processor receives commands from input devices such as keyboard 22 and mouse 24 and displays prompts for information or fields for inputting data on a graphical user interface displayed on monitor 25. Digital signals produced in accordance with the software product are conveyed to suitable digital to analog converters and anti-aliasing filters 26, 28, 30 and thence to corresponding suitable amplifiers and output source assemblies 32, 34 and 36.

It will be realized that embodiments of the invention encompass dedicated counter-surveillance devices which are arranged to implement the methods described herein.

Such apparatus are typically arranged to implement a method according to the invention by incorporating one or more suitably programmed processors.

6. VEF Hardware 6.1 Overview

This section describes an embodiment of the invention comprising a Real Time VEF system for torpedo defense.

The system may be placed on board either a surface vessel or submarine, and comprise of the wet end transmit array and on-board interfaces, processing and display.

The embodiment described here will concentrate on Surface Ship Torpedo Defence (SSTD), however embodiments of the invention are also applicable to Submarine Torpedo Defence.

6.2 Transducers

The presently described embodiment of the invention includes an array of at least three active transducers to construct the acoustic field for torpedo seduction. Active arrays come in a wide variety of shapes, sizes, frequency ranges and power levels. The most common physical shapes for high power arrays are as follows:

Hull-mounted cylindrical

Hull-mounted spherical

Towed active array

Of the above, the inventor believes that the use of either of the hull-mounted arrays is preferable over the towed active array.

The use of any of these arrays for VEF generation involves tapping or controlling the drive signals fed to the power amplifiers associated with each individually addressable transducer. The final VEF system is either connected in parallel with the current active system, or the VEF functionality may be incorporated into a complete Active/Passive/VEF sonar system.

6.2.1 Hull Mounted Cylindrical

Cylindrical bow-mounted arrays are fitted to various classes of frigates. Particular array types have characteristic transmit centre frequency and hence range performance. Each array is composed of a number of vertically positioned transmit and receive staves arranged into a cylindrical pattern. Azimuthal directional transmission is available, since each stave is able to be driven with a separate signal.

Power levels from these arrays are typically in excess of 220 dB/1 uPa.

6.2.2 Hull Mounted Spherical

Bow-mounted arrays may also be constructed in a spherical pattern of transmit and receive elements. This geometry can control both azimuthal and vertical directionality, since each transducer is able to be driven independently. Power levels are approximately the same as hull mounted cylindrical arrays may generate.

6.2.3 Towed Active Arrays

As the name suggests, towed arrays are physically towed behind a naval vessel. A typical configuration has 16 or 32 independently driveable active barrel stave transducers. Different towed array products may have differing transmit centre frequencies. The use of a towed array for VEF evaluation holds some practical and tactical implications.

Firstly, a critical angle towed array is able to operate below the acoustic ducting layer, which mat be advantageous depending on the tactics of the opposing torpedo. The flexible nature of a towed array introduces some uncertainty regarding exact transducer positional information relative to Own Ship, relative to a rigid hull mounted array. This is somewhat mitigated by the inclusion of depth and heading sensors into the array, which allow for system compensation for array movements.

6.2.4 Power Levels

The maximum power levels from these types of arrays is of the order of 214 dB//1 uPa. Significantly higher levels are available from some of the arrays.

Taking the LFA towed array as a baseline, the system is arranged to transmit at 210 dB. Deep Water Temperate Winter transmission losses, using the GSM model, predict around 80 dB transmission loss at a range of 20 km. The VEF model provides a close to destructive interference at the target position. Modelling identifies an 54 dB attenuation at the VEF "anomoly" location due to this interference.

Typical ambient noise levels $NL_A$ at the transmission frequency for high and low wind speed are as follows:

@ 21.7 kts windspeed, $NL_A(max)=67.6$ dB

@ 5 kts windspeed, $NL_A(min)=50.5$ dB

So the total Signal to Noise Ratio at 1 km under high wind speed in this configuration would be:

$$SNR=210-60-54-68=28 \text{ dB}.$$

Thus even under these conditions, a significant SNR from the VEF field is available at the torpedo. The higher transmit power of the hull mounted arrays would compensate for the increased absorption associated with their higher operating frequency. Thus it is to be expected that a similar result would hold.

6.2.5 Summary

The preceding discussion shows that an embodiment of the invention can provide a torpedo defense system with the requisite power levels for tactical usefulness.

7. VEF HARDWARE ARCHITECTURE 7.1 Introduction

A fully functional VEF system according to a preferred embodiment of the invention has the following:

Target localisation data interface
Man-Machine Interface
Array Positional Compensation Processor
Signal and Phase Generation Processor
Power Amplifier Interface It will be realized that the Array Positional Compensation Processor and the Signal and Phase Generation Processor may be one and the same depending on performance requirements.

Figure 12:
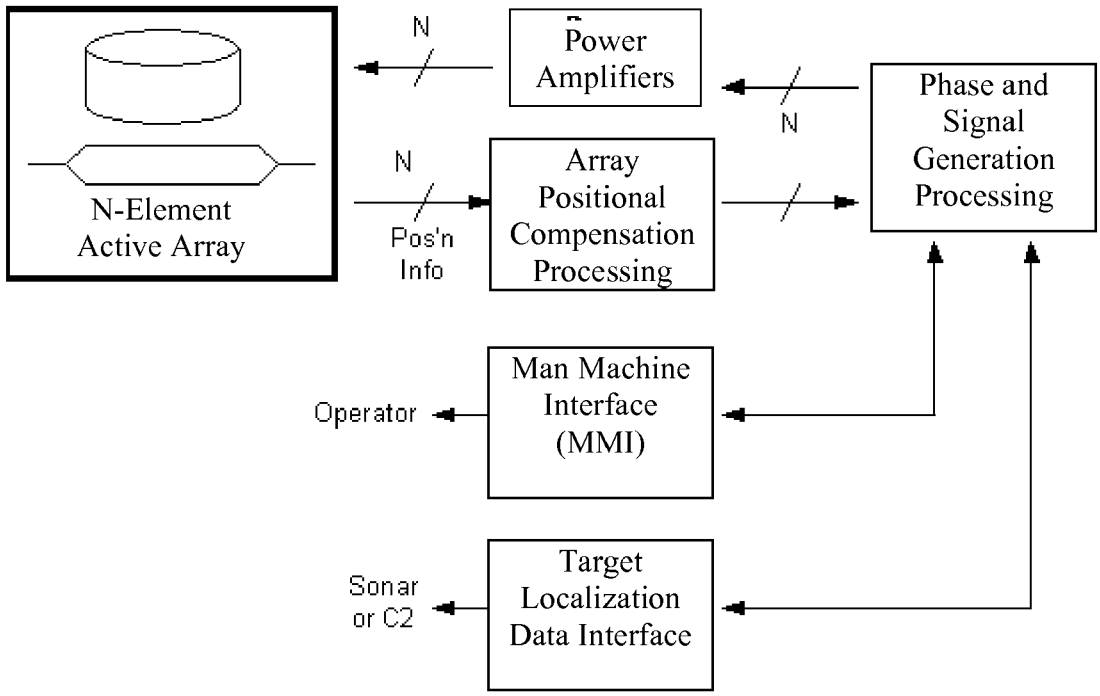
FIG. 12 is a block diagram of a projectile defense system according to an embodiment of the invention.

A schematic of an integrated VEF system is provided as FIG. 12. Each of the subsystems is described below.

7.1.1 Target Localisation Interface

The target (i.e. a projectile such as a torpedo or missile) position must be made available to the VEF system to allow for the construction of the field anomaly at the desired position. Typically the torpedo position is made available from the fire control or sonar system on board the host platform. It is desirable to have both bearing and range solutions for the torpedo to maximize the size of the anomaly around the torpedo sonar sensors.

The target position is fed continuously to the VEF processor in real time to allow the VEF system to maintain the anomaly on the target. Since modern torpedoes can operate at speeds in excess of 50 knots, this update would need to occur at >1 Hz for close inbound or high-bearing rate torpedoes.

7.1.2 Human-Machine Interface

The Human-Machine Interface (HMI) provides for operator monitoring of torpedo progress, along with VEF responses, on a Plan-Position Indicator (PPI) display surface. The PPI includes a graphical indication of the "phantom" target position as seen by the torpedo, along with torpedo and Own Ship position and speed vectors.

The VEF system may be automated to such a degree that it provides recommended transmit sequences to an operator, who would have "Veto" power to over-ride system-suggested patterns. Preferably the final VEF system is integrated with other tactical decision aids used during torpedo counter-manoeuvres.

7.1.3 Array Positional Compensation Processing

This subsystem accepts positional information from the towed array depth and heading sensors, and translates these into relative offsets for the Phase Generation processor. These offsets consist of x, y and z "delta" positional information for each transducer, relative to the linear baseline geometry of the array. Depending on the accuracy of array shape estimation sensors, the VEF system may be arranged to operate during Own Ship accelerations.

This subsystem is not required for hull-mounted arrays whose transducer positions are stable and accurately known.

7.1.4 Signal and Phase Generation Processing

This subsystem accepts data on torpedo position relative to the array, required "phantom" bearing for the false target and array shape estimation information. This data is processed to arrive at the phasing information for each transducer signal of the array. The required transmit signal is then phased appropriately for each transducer and constructed in real time for each channel.

This subsystem represents the "heart" of the VEF processor. Conceptually it is located at the centre of the system, receiving continuous update data on the target position and providing a continuous output of phased signal information to the active array.

7.1.5 Transmitter Interface

The signals for each channel of the array are then fed to the array Transmitter cabinet(s) which contains the power amplifiers required to drive the individual transducer elements.

7.2 Hardware Architecture

The hardware architecture is largely dependent on which sonar system the VEF processor is to be connected to. The hardware is arranged to provide:

System processing for overall control of VEF operation
Real time signal processing for generation of transducer signals
Interface to the active array
Interface to the sonar/C2 system for tactical data transfer
Operator Interface The control and real time processing requirements can be met by any number of Commercial-Off-The-Shelf (COTS) cards based on, say, the VMEbus. The system controller provides any standard interface protocols such as Ethernet, as required to interface to the active array.

Modern sonar and C2 systems provide interfaces (usually based on COTS network technology) through which information such as contact position may be accessed. In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

I claim:

1. A projectile defense computer software product for execution by one or more electronic processors of a projectile defense system for producing an electromagnetic or acoustic field anomaly having a desired orientation at a target location, said computer software product including instructions to process the location of a number of field sources of the projectile defense system, and
the target location; and
the desired orientation of said anomaly
to thereby produce signal parameters for said system to drive the field sources to produce the electromagnetic or acoustic field anomaly at the target location including a wavefront of the desired orientation to thereby mislead a hostile projectile approaching the target location.

2. A projectile defense computer software product according to claim 1, wherein said instructions include:

instructions to determine a solution to a condition function for the desired orientation to be produced at the target location; and
instructions to determine the signal parameters based on said solution.

3. A projectile defense computer software product as claimed in claim 1, further including:

instructions for the projectile defense system to generate signals corresponding to the signal parameters for delivery to each of the number of field sources.

4. A projectile defense computer software product as claimed in claim 1 wherein the signal parameters include the phases of the signals for the projectile defense system to apply to said sources.

5. A projectile defense computer software product as claimed in claim 2, including instructions to compute a field power function and wherein the instructions to determine a solution of the condition function take into account the field power function in order that field power at the target location be increased as said system drives the field sources to produce the electromagnetic or acoustic field anomaly at the target location to thereby mislead the hostile projectile approaching the target location.

6. A projectile defense computer software product as claimed in claim 1, wherein the number of field sources of the projectile defense system are grouped into a plurality of groups, said computer software product including:

instructions to determine solutions for the condition function corresponding to each group.

7. A projectile defense computer software product as claimed in claim 6, further including:

instructions to determine a group phase angle contribution, at the target location, for each group of field sources of the projectile defense system.

8. A projectile defense computer software product as claimed in claim 7, further including:

instructions to deduce a phase angle for each of the sources of the group on the basis of the corresponding group phase contribution and the solution of the condition function.

9. A projectile defense computer software product as claimed in claim 5 further including:

instructions to calculate a digital signal at each source of the projectile defense system on the basis of the determined signal parameters and a predetermined deception signal.

10. A projectile defense system including one or more electronic processors programmed with a computer software product according to claim 1.

11. A projectile defense system comprising:

a phase and signal generation processor programmed to execute a software product according to claim 1;

a target localization interface in communication with the phase and signal generation processor and arranged to generate target location data specifying the target location from a projectile tracking system; and an array of power amplifiers responsive to the phase and signal generation processor and arranged to drive each of an array of transducers to produce said anomaly at the target location corresponding to the target location, to thereby mislead the hostile projectile approaching the target location.

12. A projectile defense system according to claim 11, wherein the array of transducers comprises a towed array having depth and heading sensors; and wherein said defense system further includes an array positional compensation processor arranged to process data from said sensors to produce delta positional data for processing by the phase and signal generation processor.

13. A projectile defense system according to claim 11, wherein the hostile projectile comprises a missile and wherein the projectile tracking system comprises a radar system.

14. A projectile defense system according to claim 11, comprising a human-machine interface in communication with the signal and phase generation processor for receiving commands from and presenting information to a human operator of said system.

15. A projectile defense system comprising:

a projectile tracking system for tracking a hostile projectile;

a target localisation interface responsive to the projectile tracking system and arranged to generate target location data therefrom;

a signal and phase generation processor arranged to process the target location data to thereby calculate parameters of a field anomaly characterized by a wavefront of a desired orientation for presentation to the hostile projectile; and a plurality of transducers under control of the signal and phase generation processor to present the field anomaly to said projectile and thereby mislead the hostile projectile.

16. A projectile defense system according to claim 15 including a display surface for presenting a graphical indication of a phantom target position corresponding to the field anomaly.

17. A projectile defense method including:

tracking a hostile projectile to determine a target associated therewith;

operating a number of transducers to produce a field anomaly characterized by a wavefront of a desired orientation within range of sensors of said hostile projectile to thereby mislead said sensors to mistake a phantom target caused by the field anomaly for the target.

18. A projectile defense method according to claim 17 including operating said transducers in groups wherein each said group is tuned to create a corresponding field anomaly at said target whereby amplitudes of said field anomalies add coherently thus increasing an overall field anomaly amplitude at the target.

* * * * *